US010263372B2

(12) United States Patent
Yao et al.

(10) Patent No.: US 10,263,372 B2
(45) Date of Patent: Apr. 16, 2019

(54) ELECTRICAL CONNECTOR HAVING INSULATIVE HOUSING WITH A REAR STEPPED PORTION ASSISTING IN FORMATION OF A WATERPROOF SHEET

(71) Applicant: FOXCONN INTERCONNECT TECHNOLOGY LIMITED, Grand Cayman (KY)

(72) Inventors: Tao Yao, Huaian (CN); Hendrikus P. G. Van der Steen, Den Dungen (NL); Chin-Yu Chen, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/490,785

(22) Filed: Apr. 18, 2017

(65) Prior Publication Data

US 2017/0302037 A1 Oct. 19, 2017

(30) Foreign Application Priority Data

Apr. 18, 2016 (CN) ..... 2016 1 0238603
Apr. 28, 2016 (CN) ..... 2016 1 0271340

(51) Int. Cl.
*H01R 13/648* (2006.01)
*H01R 24/60* (2011.01)
(Continued)

(52) U.S. Cl.
CPC ..... *H01R 24/60* (2013.01); *H01R 12/716* (2013.01); *H01R 13/405* (2013.01);
(Continued)

(58) Field of Classification Search
CPC .. H01R 12/57; H01R 13/5205; H01R 23/688; H01R 23/6873; H01R 13/5216
(Continued)

(56) References Cited

U.S. PATENT DOCUMENTS 8,388,380 B1 * 3/2013 Van der Steen ... H01R 13/5202 439/607.36
8,827,742 B2 * 9/2014 Wang ..... H01R 24/68 439/569
(Continued)

FOREIGN PATENT DOCUMENTS

CN 201408857 Y 2/2010
CN 201754435 3/2011
(Continued)

*Primary Examiner* — Thanh Tam T Le
(74) *Attorney, Agent, or Firm* — Wei Te Chung; Ming Chieh Chang

(57) ABSTRACT

An electrical connector includes: an insulative housing comprising a base portion defining a rearward surface and a tongue portion extending forwardly from the base portion; plural conductive terminals affixed to the insulative housing and each having a contacting portion exposed to the top and bottom surfaces of the tongue portion, a fixing portion embedded in the base portion, and a soldering portion extending backwardly out of the base portion; a shielding plate affixed to the insulative housing; a shielding shell covering the insulative housing and defining a sol space with the rearward surface of the base portion; and a waterproof sheet; wherein the base portion further comprises a stepped portion in the sol space, the waterproof sheet is formed by solidification of liquid insulative material flowing from the stepped portion to the rearward surface, and the waterproof sheet encloses the stepped portion.

14 Claims, 28 Drawing Sheets

(51) Int. Cl.

| | |
|---|---|
| ***H01R 13/52*** | (2006.01) |
| ***H01R 13/6581*** | (2011.01) |
| ***H01R 12/71*** | (2011.01) |
| ***H01R 13/405*** | (2006.01) |
| ***H01R 13/6595*** | (2011.01) |
| *H01R 107/00* | (2006.01) |

(52) U.S. Cl.
CPC ..... *H01R 13/521* (2013.01); *H01R 13/6581* (2013.01); *H01R 13/6595* (2013.01); *H01R 2107/00* (2013.01)

(58) Field of Classification Search
USPC ..... 439/83, 589, 607.11, 607.23, 607.35, 439/607.4, 660, 936
See application file for complete search history.

(56) References Cited

U.S. PATENT DOCUMENTS

| | | | | |
|---|---|---|---|---|
| 8,851,927 | B2 * | 10/2014 | Hsu | H01R 12/724 439/607.11 |
| 9,022,800 | B2 * | 5/2015 | Yang | H01R 13/6581 439/487 |
| 9,281,608 | B2 | 3/2016 | Zhao et al. | |
| 9,429,360 | B2 | 8/2016 | Hsiao | |
| 9,444,177 | B2 | 9/2016 | Tsai | |
| 9,502,839 | B2 | 11/2016 | Tsai | |
| 9,705,267 | B2 * | 7/2017 | Cheng | H01R 24/60 |
| 9,711,910 | B2 * | 7/2017 | Zhao | H01R 13/6581 |
| 9,812,827 | B2 * | 11/2017 | Guo | H01R 12/75 |
| 9,853,387 | B2 * | 12/2017 | Dai | H01R 13/405 |
| 2015/0244099 | A1 | 8/2015 | Lee | |
| 2016/0056568 | A1 | 2/2016 | Lo | |
| 2016/0181722 | A1 | 6/2016 | Tsai | |
| 2016/0329667 | A1 | 11/2016 | Tsai | |

FOREIGN PATENT DOCUMENTS

| | | |
|---|---|---|
| CN | 203983548 U | 12/2014 |
| CN | 204045829 | 12/2014 |
| CN | 204315771 U | 5/2015 |
| CN | 204696371 | 10/2015 |
| CN | 204809445 U | 11/2015 |
| CN | 204858007 U | 12/2015 |
| CN | 103208698 A | 1/2016 |
| CN | 205029113 U | 2/2016 |
| CN | 205159614 | 4/2016 |

* cited by examiner

ELECTRICAL CONNECTOR HAVING INSULATIVE HOUSING WITH A REAR STEPPED PORTION ASSISTING IN FORMATION OF A WATERPROOF SHEET

BACKGROUND OF THE DISCLOSURE

1. Field of the Disclosure

The present disclosure relates to a waterproof electrical connector suitable for insertion of a mating connector in dual orientations, and also to an electrical connector clipped onto a printed circuit board.

2. Description of Related Arts

U.S Patent Application Publication No. 2016/0329667 discloses a reversible or dual orientation USB Type-C receptacle connector comprising a metallic shell, an insulative housing, a plurality of first and second terminals, a recess structure, and a passage structure. The recess structure is for being filled by a sealing member in liquid state. The sealing member may be further filled into the passage structure from the recess structure so that the rear of the insulative housing is completely filled.

An improved electrical connector is desired.

SUMMARY OF THE DISCLOSURE

Accordingly, an object of the present disclosure is to provide an electrical connector ensuring the waterproof effect of the electrical connector.

To achieve the above object, an electrical connector includes: an insulative housing comprising a base portion defining a rearward surface and a tongue portion extending forwardly from the base portion; plural conductive terminals affixed to the insulative housing and each having a contacting portion exposed to the top and bottom surfaces of the tongue portion, a fixing portion embedded in the base portion, and a soldering portion extending backwardly out of the base portion; a shielding plate affixed to the insulative housing; a shielding shell covering the insulative housing and defining a sol space with the rearward surface of the base portion; and a waterproof sheet; wherein the base portion further comprises a stepped portion in the sol space, the waterproof sheet is formed by solidification of liquid insulative material flowing from the stepped portion to the rearward surface, and the waterproof sheet encloses the stepped portion.

Another object of the present invention is to provide a non-solder, card edge type electrical connector for mounting to a printed circuit board (PCB), comprising: an insulative piece including an insulative housing having a base portion and a tongue portion extending forwardly from the base portion; a plurality of first terminals and second terminals affixed to the insulative housing, each terminal comprising a contact portion exposed to the tongue portion and an elastic portion extending backwardly out of the base portion; a metal piece affixed to the insulative piece and comprising a plurality of first and second elastic arms extending backwardly; and a shielding shell enclosing the insulative housing for forming a receiving room; wherein the first and second elastic arms, the elastic portions of the first terminals, and the elastic portions of the second terminals clip onto the PCB elastically along a vertical direction. advantages and novel features of the disclosure will become more apparent from the following detailed description when taken in conjunction with the accompanying drawings.

DETAILED DESCRIPTION OF THE PREFERRED EMBODIMENT

Figure 1:
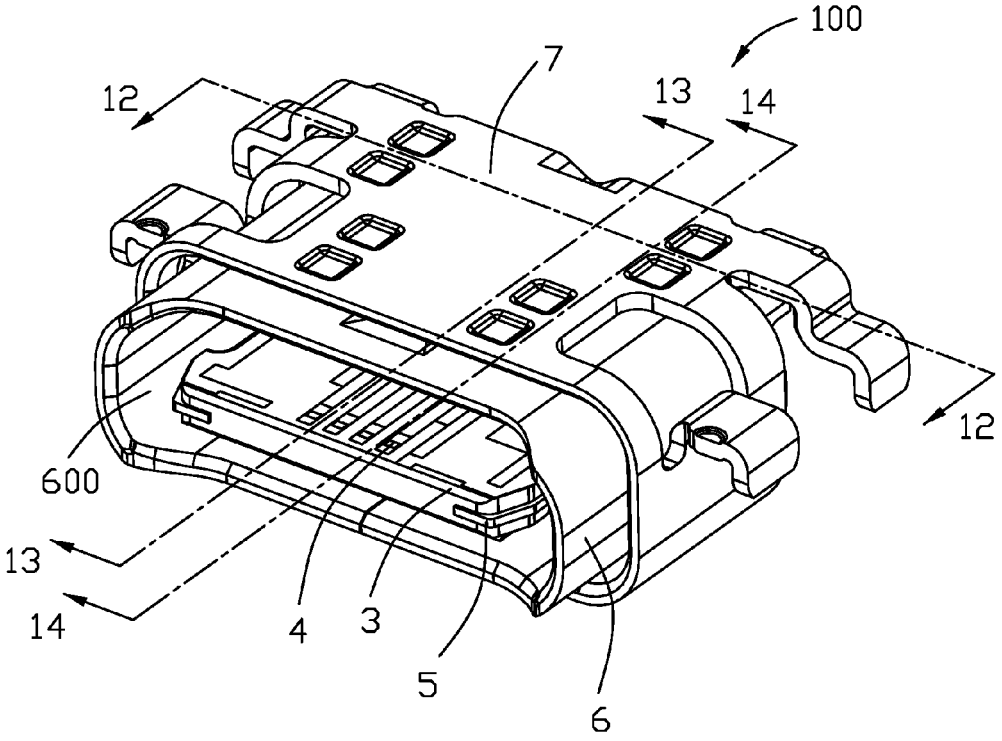
FIG. 1 is a perspective, assembled view of an electrical connector in the first embodiment.
Figure 2:
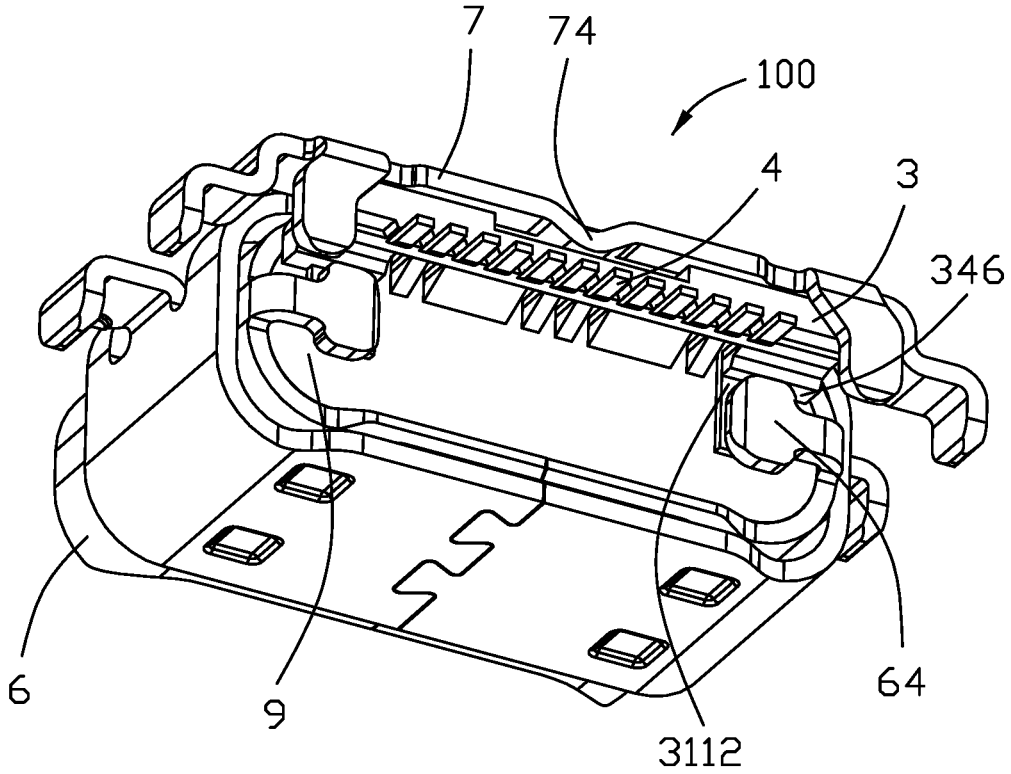
FIG. 2 is another perspective, assembled view of the electrical connector taken from FIG. 1.
Figure 3:
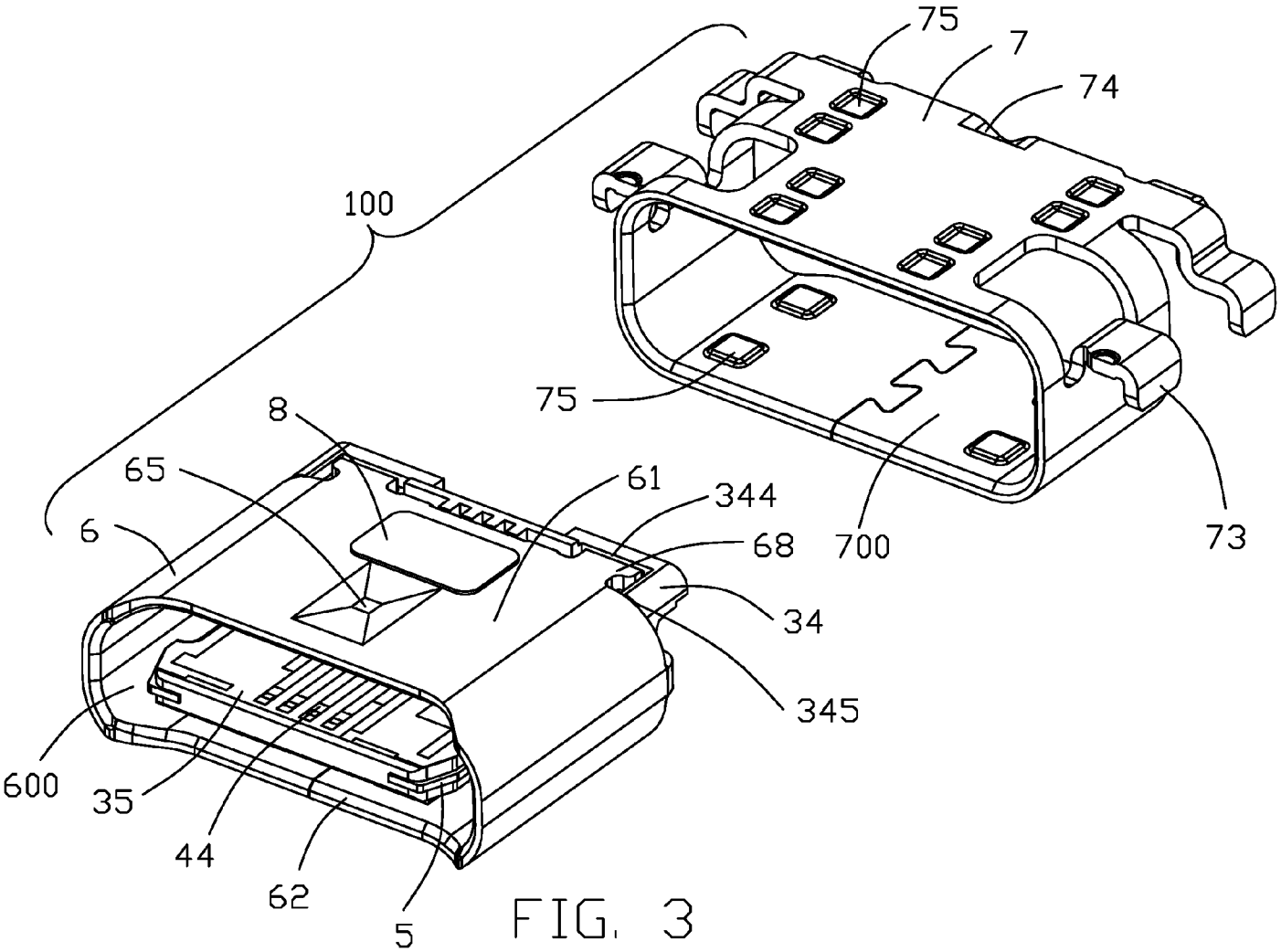
FIG. 3 is a partial exploded view of the electrical connector in the first embodiment.
Figure 4:
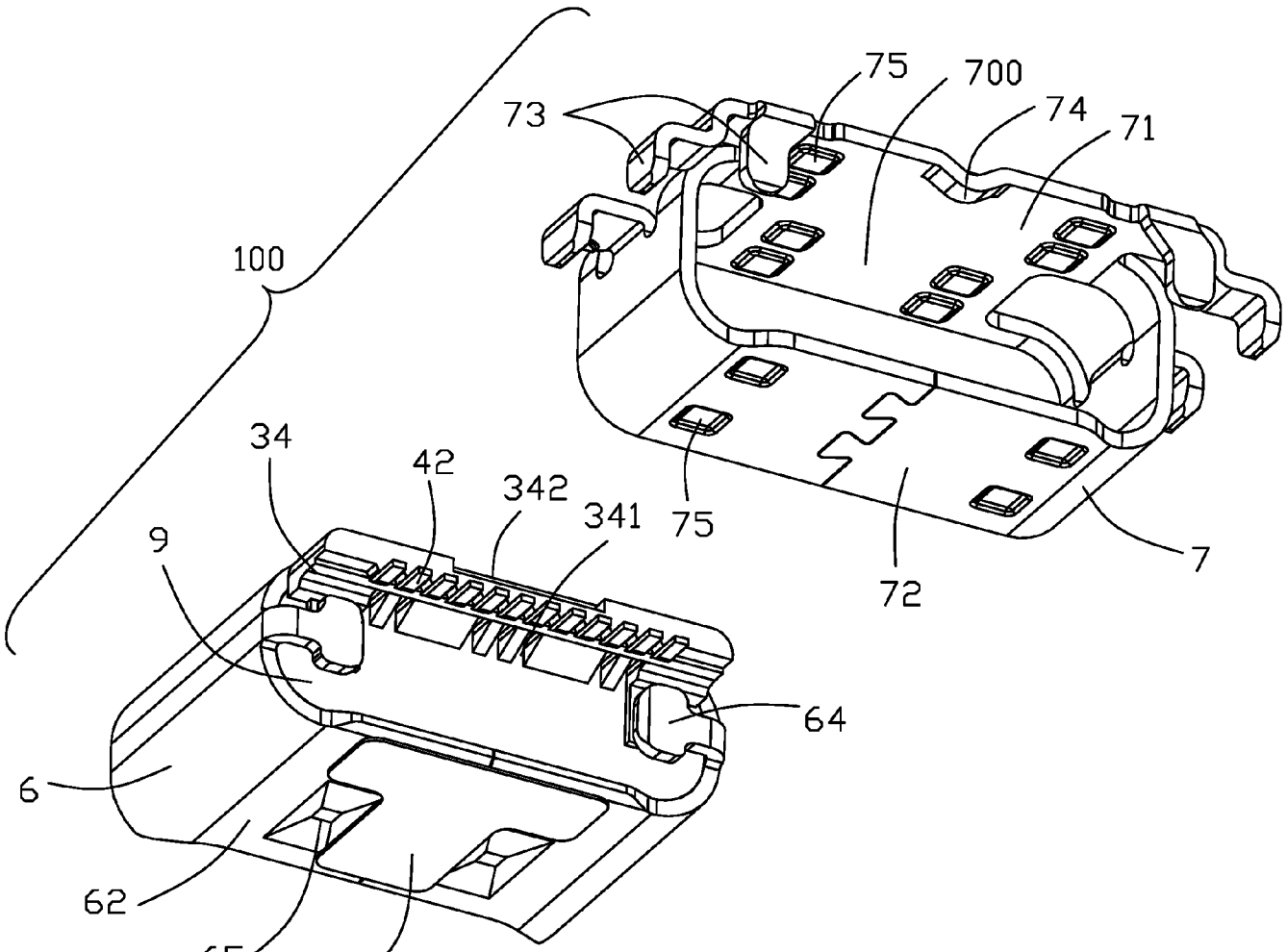
FIG. 4 is another partial exploded view of the electrical connector taken from FIG. 3.
Figure 5:
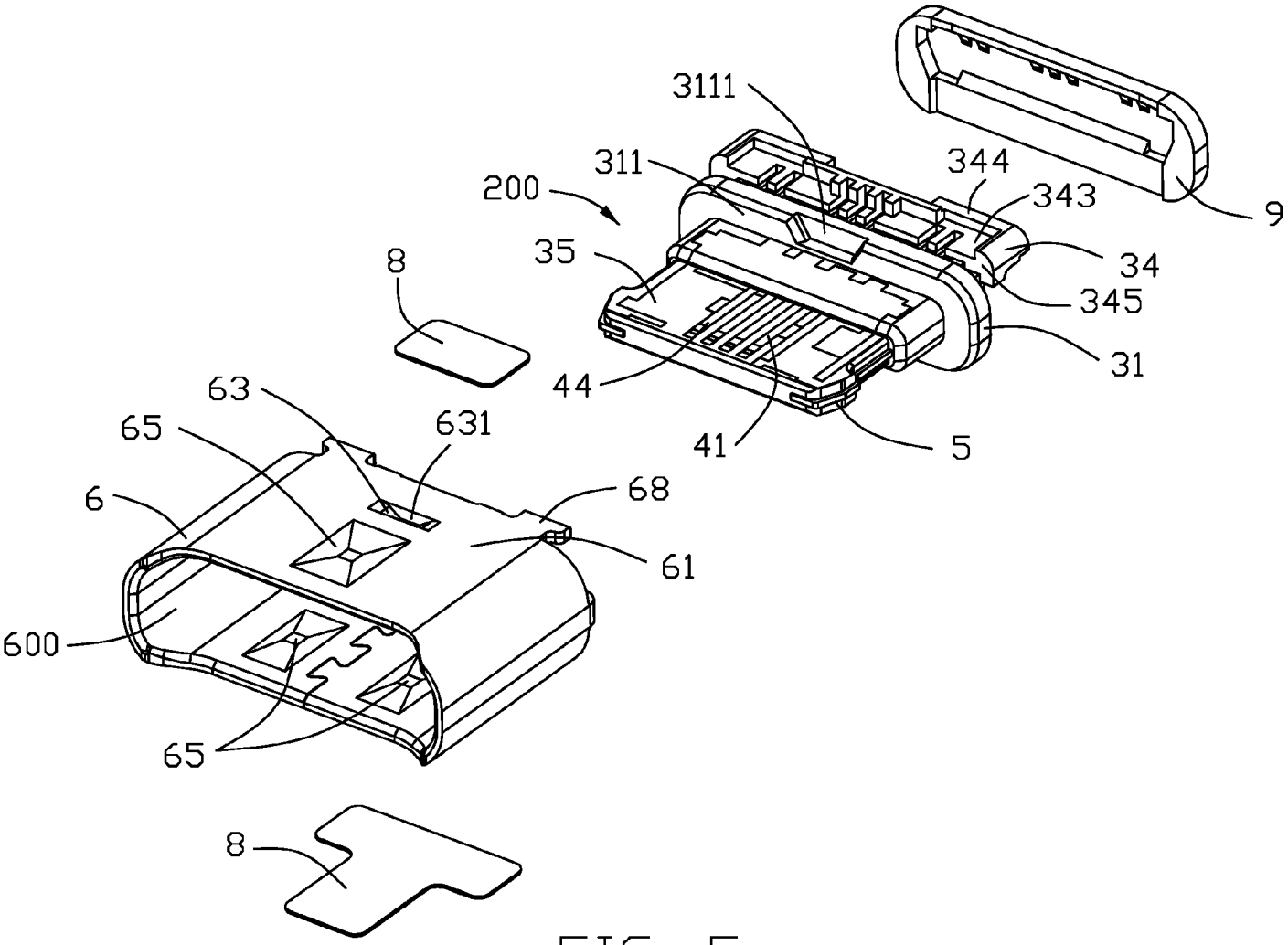
FIG. 5 is another partial exploded view of the electrical connector removing the metal shell in the first embodiment.
Figure 6:
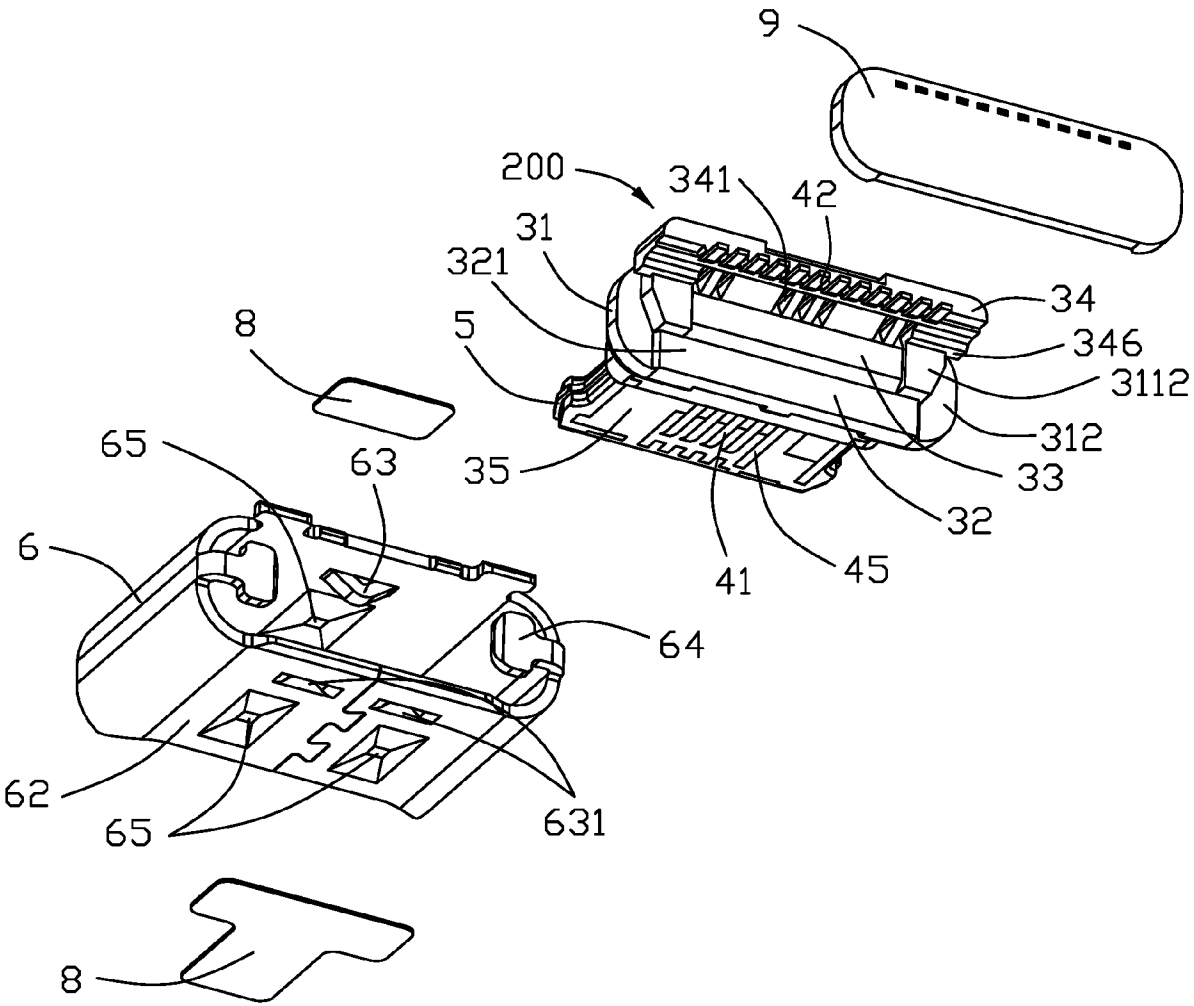
FIG. 6 is a partial exploded view of the electrical connector taken from FIG. 5.
Figure 7:
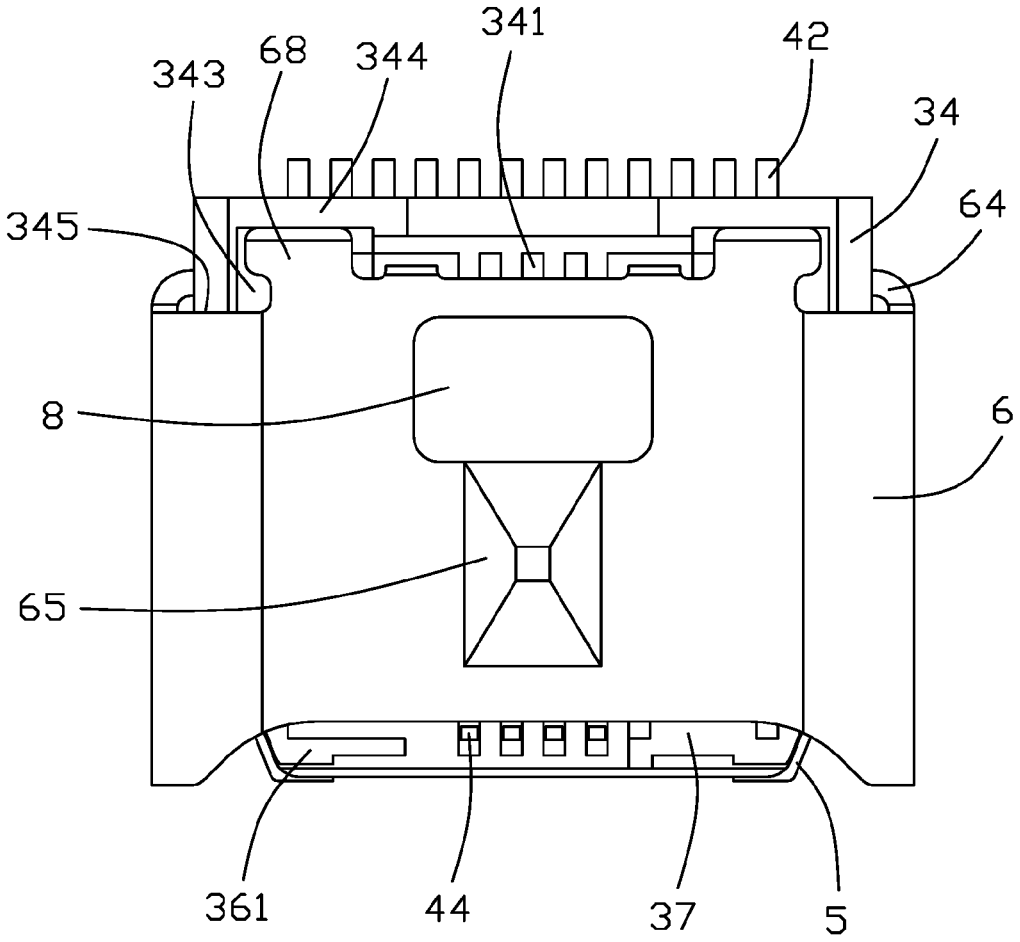
FIG. 7 is a top view of the electrical connector removing the metal shell from a top-to-bottom direction in the first embodiment.
Figure 8:
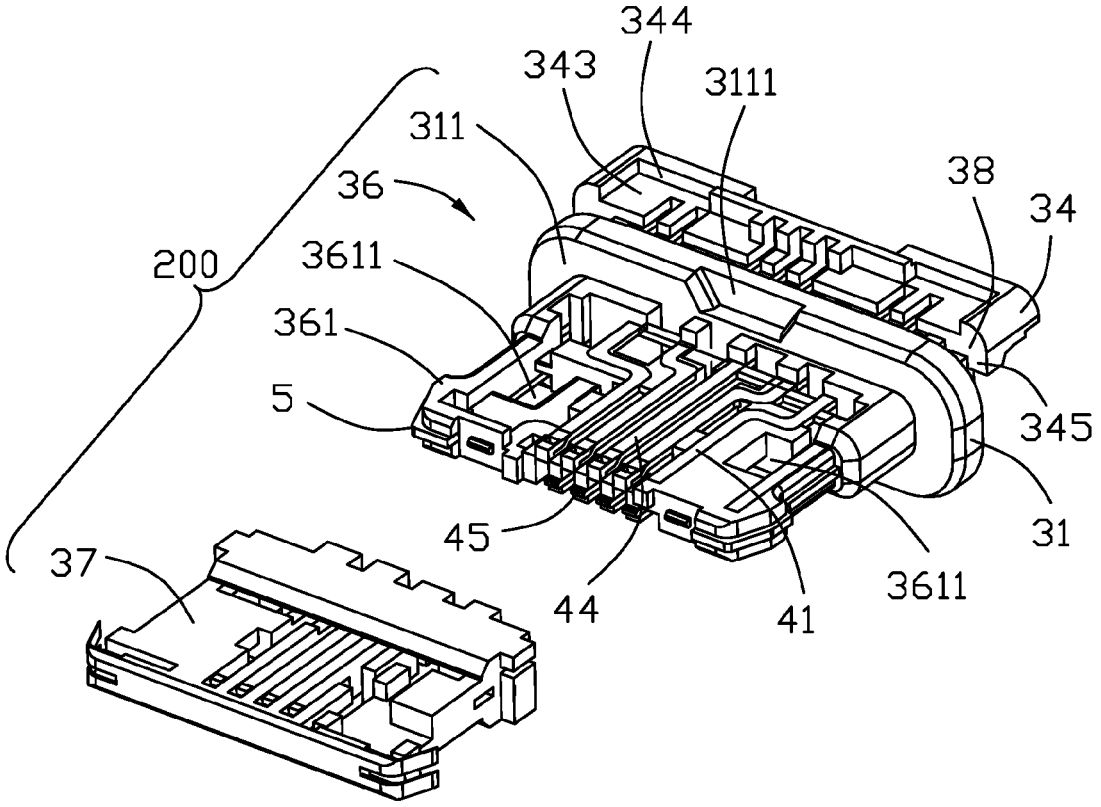
FIG. 8 is a partial exploded view of the contact module of the electrical connector in the first embodiment.
Figure 9:
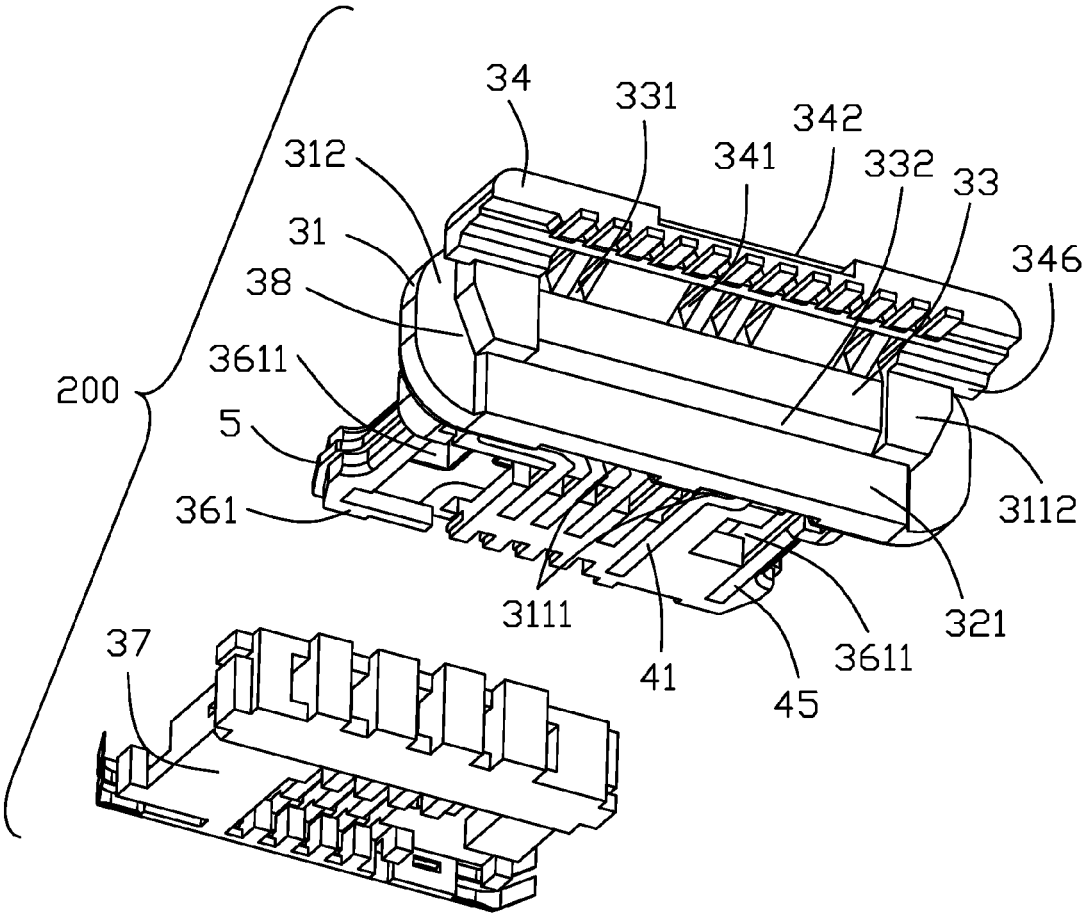
FIG. 9 is another exploded view of the contact module taken from FIG. 8.
Figure 10:
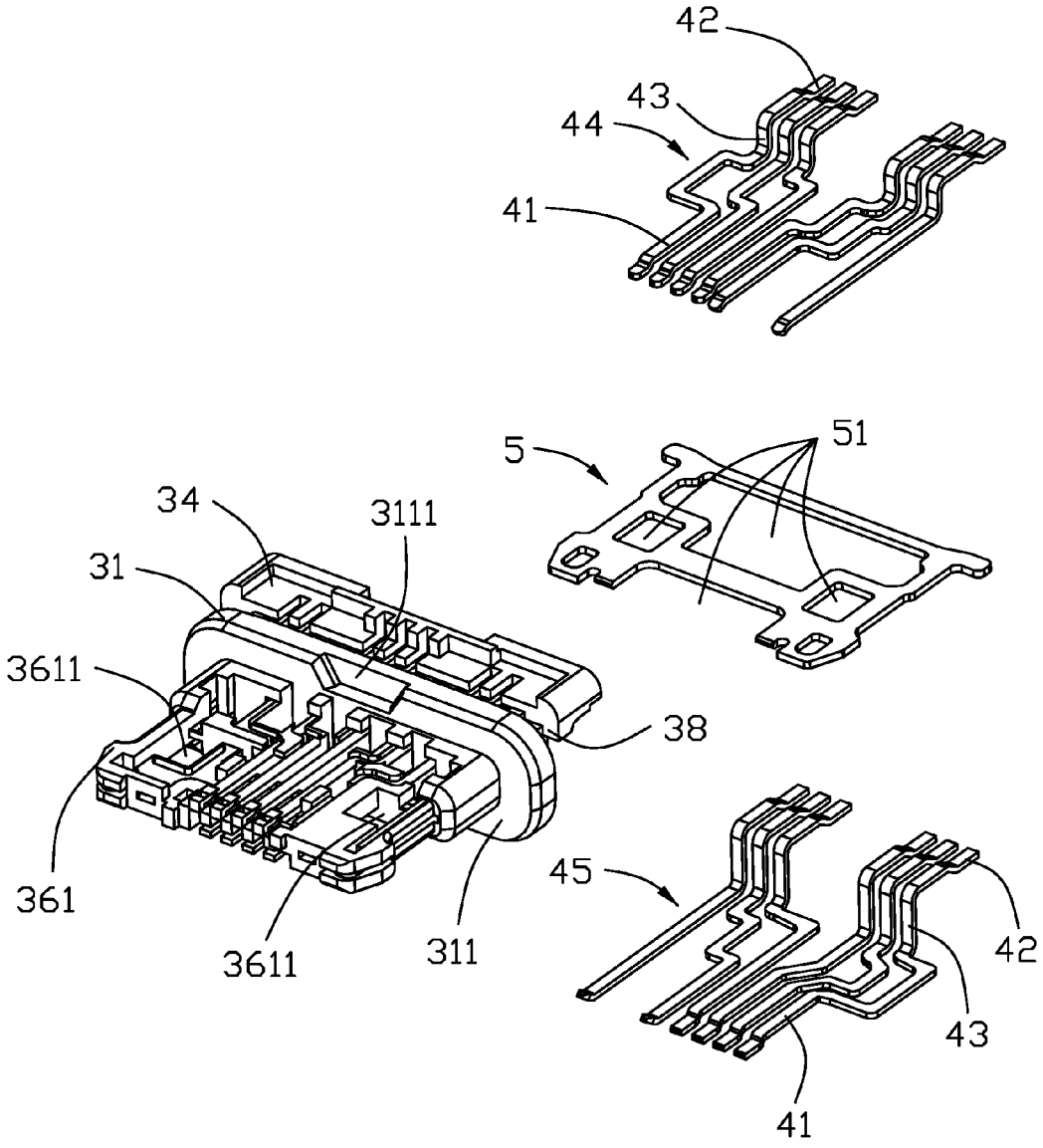
FIG. 10 is an exploded view of the contact module removing the second insulator in the first embodiment.
Figure 11:
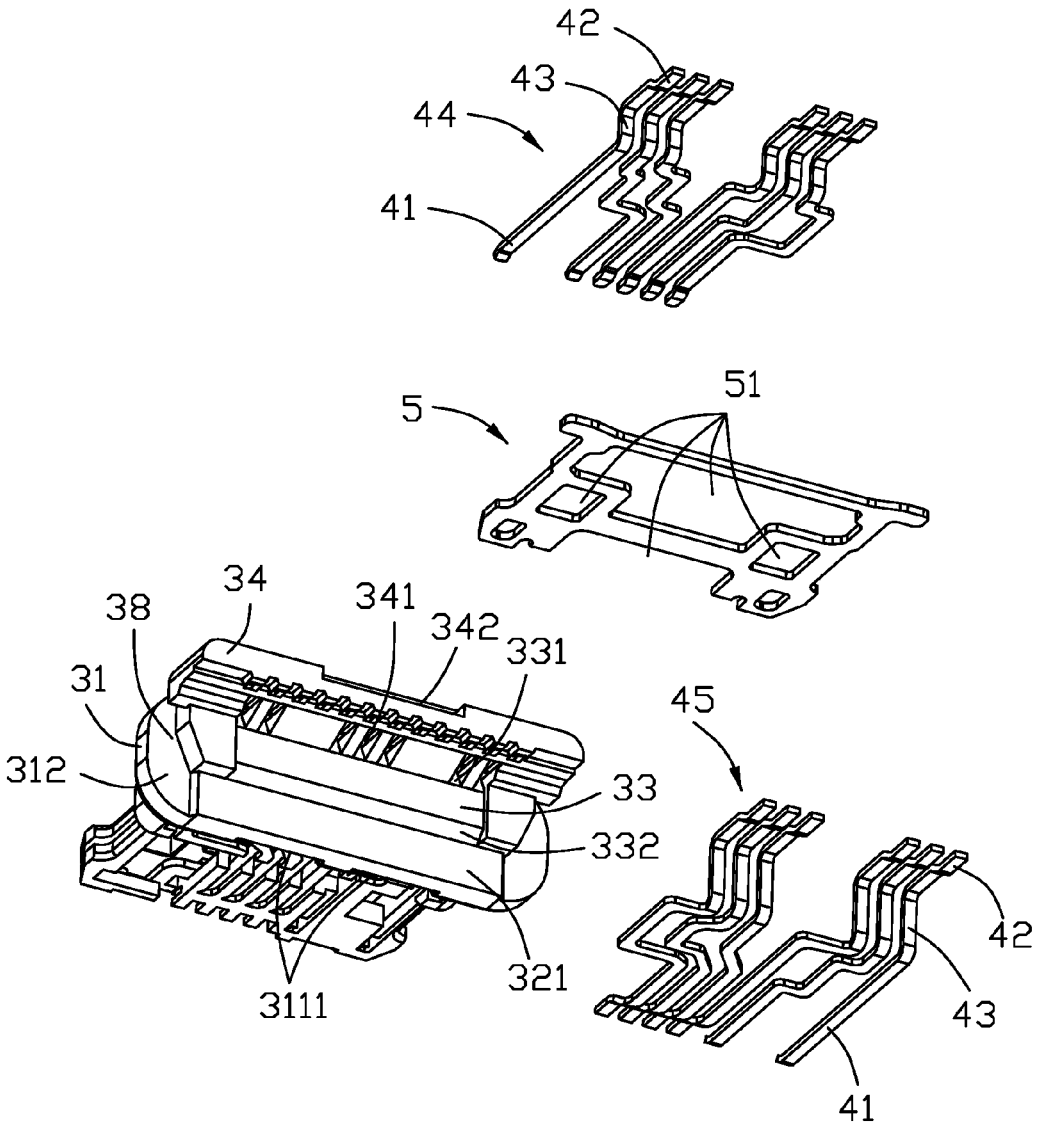
FIG. 11 is another exploded view taken from FIG. 10.
Figure 12:
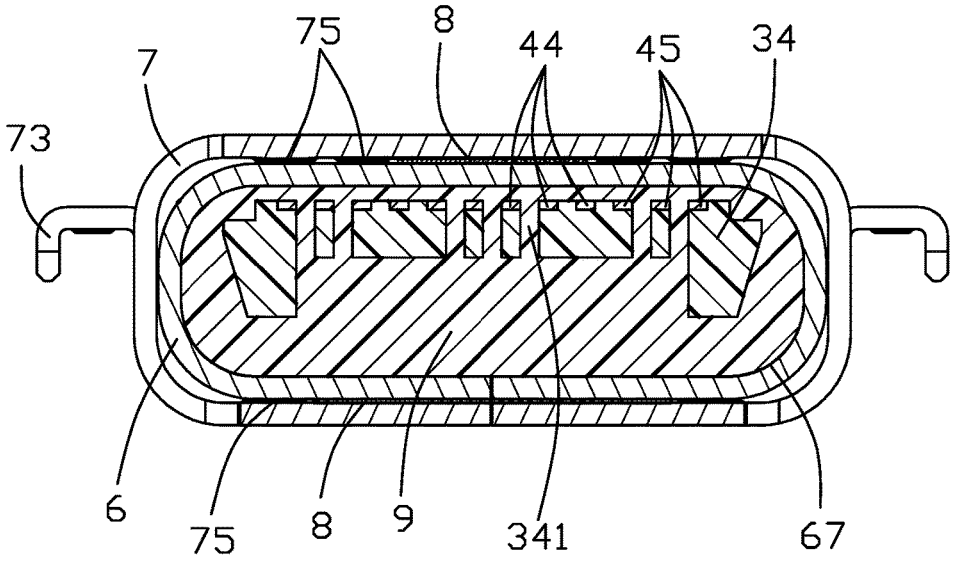
FIG. 12 is a cross-sectional view of the electrical connector taken along line 12-12 in FIG. 1.
Figure 13:
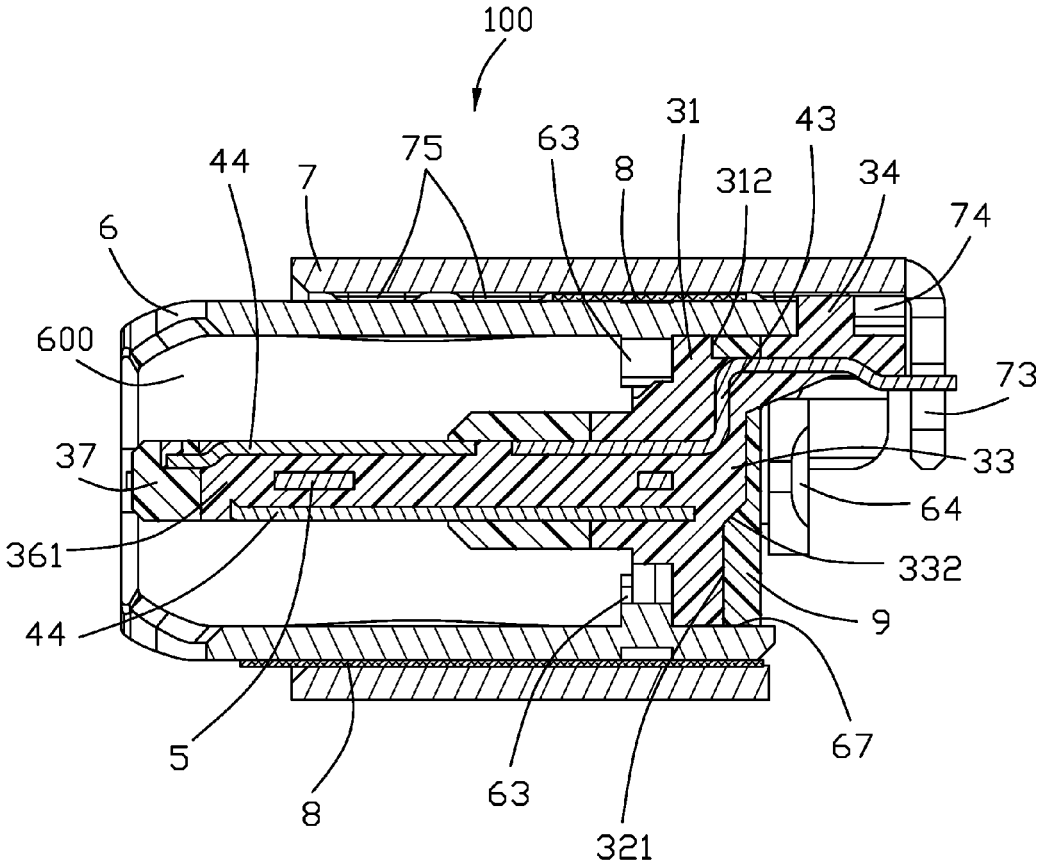
FIG. 13 is a cross-sectional view of the electrical connector taken along line 13-13 in FIG. 1.
Figure 14:
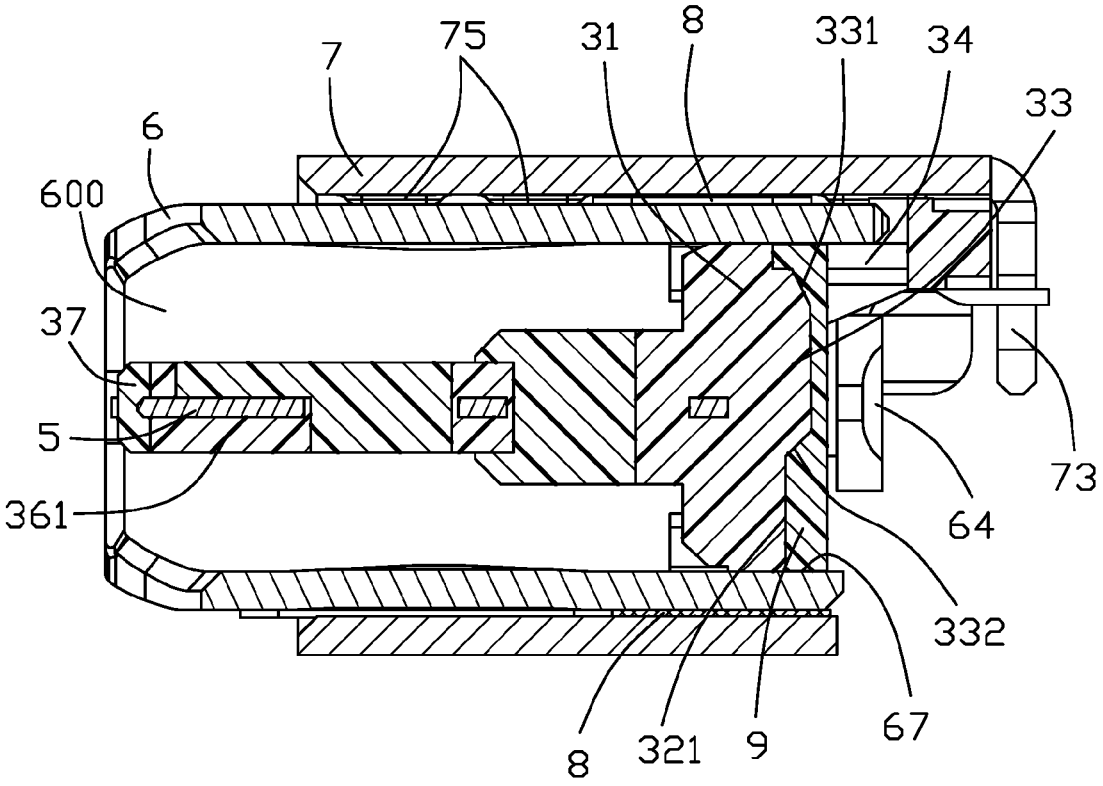
FIG. 14 is a cross-sectional view of the electrical connector taken along line 14-14 in FIG. 1.

Reference will now be made in detail to the embodiments of the present disclosure. The first embodiment is shown from FIGS. 1 to 14. The second embodiment is shown from FIGS. 15 to 28.

Referring to FIGS. 1 to 14, an electrical connector 100 comprises: an insulative housing 3, a plurality of conductive terminals 4 affixed to the insulative housing 1, a shielding plate 5 affixed to the insulative housing 1, a shielding shell 6 enclosing the insulative housing 3, a metal shell 7 enclosing the shielding shell 6, a plurality of waterproof pieces 8 and a waterproof sheet 9.

Referring to FIGS. 1 to 14, the insulative housing 3 comprises a base portion 31 and a tongue portion 35 extending forwardly from the tongue portion 35. The insulative housing 3 further includes a first insulator 36 and a second insulator 37. The base portion 31 defines a front surface 311 and a rearward surface 312.

The first insulator 36 includes the base portion 31 and a first tongue portion 361 extending forwardly from the front surface 311. The first tongue portion 361 includes a plurality of penetrating holes 3611 penetrating downwardly and locating among the conductive terminals 4. The base portion 31 further includes a pair of protrusions 3112 protruding backwardly from the base portion 31, a positioning slot 3111 located at the front surface 311, a stepped portion 32 extending backwardly from the rearward surface 312, a rear portion 34 extending backwardly from the upper portion of the base portion 31, and a channel 38. The protrusions 3112 are on both sides of the stepped portion 32. The stepped portion 32 connects the rearward surface 312 and the rear portion 34 and includes a first stepped surface 321, a second stepped surface 33 arranged in different surfaces with the first stepped surface 321, a first inclining surface 331 connecting the first stepped surface 321 and the rear portion 34 and a second inclining surface 332 connecting the first stepped surface 321 and the second stepped surface 33. The first stepped surface 321 is behind the rearward surface 312 along a front-to-back direction. The second stepped surface 33 is behind the first stepped surface 321 along the front-to-back direction. The protrusions 3112 is behind the second stepped surface 33. The rear portion 34 further includes a plurality of through holes 341 penetrating upwardly and downwardly and positioning behind the first inclining surface 331, a pair of resisting grooves 343 located on the upper surface of the rear portion 34, a pair of resisting surfaces 345 located in the front of two sides of the rear portion 34, a pair of dependent portions 346 located at the bottom of the rear portion 34 and closing to the protrusions 3112 and a notch 342 located at a rear end of the rear portion 34. Each through hole 341 is located between two adjacent conductive terminals 4. The resisting grooves 343 include a pair of limiting walls 344 located at the edge thereof. The dependent portions 346 and the protrusions 3112 form a stepped shape respectively. The channel 38 is formed between the rearward surface 312 and the rear portion 34.

The second insulator 37 is injection molding with the first insulator 36. The second insulator 37 fills in the penetrating holes 3611 and partially encloses the first tongue portion 361. The second insulator 37 covers the front end of the first tongue portion 361. The first tongue portion 361 and the second insulator 37 compose the tongue portion 35. The base portion 31 of the first insulator 36 is the base portion 31 of the insulative housing 3.

Referring to FIGS. 1 to 14, the conductive terminals 4 comprise a plurality of upper terminals 44 and a plurality of lower terminals 45. Each conductive terminal 4 comprises a contacting portion 41 exposed on the top surface or the bottom surface of the tongue portion 35, a soldering portion 42 extending backwardly out of the rear portion 34 and a fixing portion 43 connecting the contacting portion 41 and the soldering portion 42 and affixed to the base portion 31. The upper terminals 44 and the lower terminals 45 are affixed to the first insulator 36.

Referring to FIGS. 1 to 14, the shielding plate 5 is affixed to the first insulator 36. The shielding plate 5 includes a hollow area 51 corresponding to the penetrating holes 3611.

The first insulator 36, the second insulator 37, the upper terminals 44, the lower terminals 45 and the shielding plate 5 compose a contact module 200.

Referring to FIGS. 1 to 7 and FIGS. 12 to 14, the shielding shell 6 includes a mating room 600 and defines a top wall 61 and a bottom wall 62. The shielding shell 6 includes a plurality of front blocking portions 63 located between the top wall 61 and the bottom wall 62, a pair of resisting portions 68 extending backwardly from a rear end of the top wall 61, a pair of rear blocking portions 64 and a plurality of tubers 65 protruding into the mating room 600 and located between the top wall 61 and the bottom wall 62. The resisting portions 68 are flat-structure. The pair of rear portions 34 is located besides two lateral walls of a rear end of the shielding shell 6.

Referring to FIGS. 1 to 4 and FIGS. 12 to 14, the metal shell 7 defines a receiving room 700. The metal shell 7 comprises a top board 71 including a plurality of convex portions 75 protruding into the receiving room 700, a bottom board 72 having the convex portions 75 in symmetrical arrangement, a plurality of fixing pins 73 located at two lateral walls of the metal shell 7 and a positioning portion 74 at the rear end of the metal shell 7. The convex portions 75 is shaped a arc-shape by tearing molding and includes an opening 631 on an outer surface of the top wall 61 and bottom wall 62.

Referring to FIGS. 1 to 14, the method of making the electrical connector 100 comprises three steps. In first step, provide a contact module 200 affixing a plurality of conductive terminals 4. The contact module 200 includes a channel 38, a stepped portion 32, a first insulator 36, a second insulator 37, a plurality of upper terminals 44 and lower terminals 45 and a shielding plate 5. The shielding plate 5 is punched stamped stainless. Firstly the upper terminals 44 with material string, the lower terminals 45 with material string, the shielding plate 5 with material string is injection molding with the first insulator 36. The each of the upper terminals 44 is associated with a respective one of the lower terminals 45 and is positioned in reverse symmetry with respect to the lower terminals 45. The contacting portions 41 of the upper terminals 44 are exposed to the top surface of the tongue portion 35. The contacting portions 41 of the lower terminals 45 are exposed to the bottom surface of the first tongue portion 361. The fixing portions 43 bend upwardly and then extend backwardly to form the soldering portions 42. The rear end of the fixing portions 43 of the upper terminals 44 are in the same row with the rear end of the fixing portions 43 of the lower terminals 45. The soldering portions 42 of the upper terminals 44 are in the same plane with the soldering portions 42 of the lower terminals 45. The soldering portions 42 of three upper terminals 44 and the soldering portions 42 of three lower terminals 45 are in a row in a transverse direction. The material string of the upper terminals 44 and the lower terminals 45 are exposed to the penetrating holes 3611. The shielding plate 5 is sandwiched between the upper terminals 44 and the lower terminals 45 making the lateral sides of the shielding plate 5 exposed to the two sides of the tongue portion 35 to connect with the corresponded electrical connector. Cut off the material strings making the second insulator 37 injection molding with the first insulator 36 to be the contact module 200.

In the second step, provide a shielding shell 6 and two waterproof pieces 8. The shielding shell 6 is formed by punched stamped stainless and comprises a riveting seam. The shielding shell 6 defines a mating room 600. The shielding shell 6 encloses the contact module 200. The tongue portion 35 is located at the mating room 600. There exists a sol space 67 between the rearward surface 312 of the contact module 200 and the shielding shell 6. The sol space 67 penetrates the channel 38 making the stepped portion 32 received in the sol space 67. The front blocking portions 63 resist backwardly against the positioning slots 3111. The pair of resisting portions 68 is received in the resisting grooves 343. The resisting portions 68 resist downwardly against the resisting grooves 343 and resist backwardly and laterally against the limiting walls 344. The edge of the backend of the shielding shell 6 resists the pair of resisting surfaces 345. The front blocking portion 63, the resisting portions 38 and the backend of the shielding shell 6 prevent the contact module 200 moving forwardly. The pair of rear blocking portions 64 resist forwardly against the backend of the protrusions 3112 and resist upwardly against the bottom of the dependent portion 346 preventing the contact module 200 moving backwardly and inclining in the shielding shell 6. The front blocking portions 63 extend out of the positioning slot 3111 preventing the contact module 200 damaging when the corresponded electrical connector inserts into the electrical connector 100. Each waterproof piece 8 is respectively attached to the top wall 61 or the bottom wall 62 for sealing the riveting seams and the opening 631 preventing water going into the electrical device through the riveting seams and the opening 631.

In the third step, provide a metal shell 7 and insulative liquid material. The metal shell 7 is punched stamped stainless. The metal shell 7 encloses the shielding shell 6 making the positioning portions 74 received in the notch 342 and resisting forwardly against the rear portion 34 for preventing the contact module 200 moving backwardly. The convex portions 75 of the top board 71 and the bottom board 72 sandwich the shielding shell 6 and affixed to the shielding shell 6 by soldering. The convex portions 75 are away from the waterproof pieces 8. Make the rearward surface 312 shown upwardly. Inject the insulative liquid material into the stepped portion 32 making the insulative liquid material flow from the first stepped surface 321 to the rearward surface 312 to fill in the channel 38 because of gravity. The insulative liquid material, i.e., the glue, is injected into the upper second stepped surface 33 making the insulative liquid material going through the through holes 341. The first inclining surface 331 and the second inclining surface 332 contribute to the flowing of the insulative liquid material for filling in the sol space 67. After solidification, the insulative liquid material becomes a waterproof sheet 9. The waterproof sheet 9 fills in the channel 38 and goes through the through holes 341. The waterproof sheet 9 encloses the first stepped surface 321 and the second stepped surface 33 for sealing the gap between the insulative housing 3 and the shielding shell 6. The metal shell 7 is affixed to the PCB by the fixing pins 73 making the shielding shell 6 and the metal shell 7 touchdown.

Compared with prior art which essentially has a flat rearward surface without any stepped portion thereon, the electrical connector includes the stepped portion 32, the second stepped surface 33, and the through holes 341 to promote flowing of the insulative liquid material and filling in the sol space 67. The rear blocking portions 64, the front blocking portions 63, the resisting portions 68 and the rear edge of the shielding shell 6 resist the contact module 200 from all directions. The positioning portions 74 resist forwardly against the contact module 200. The above arrangements ensure the stability of the contact module 200. Notably, in this embodiment, a top portion of the rearward surface 312 is hidden within the rear portion 34 while the first inclining surface 331 in the corresponding through hole 341 may efficiently lead the liquid insulative material 9 from the second step surface 33 toward the rearward surface 312.

Referring to FIGS. 15 to 27, the second embodiment is shown. The electrical connector 100' is connected to a PCB 200' and includes an insulative piece comprising an insulative housing, a plurality of terminals affixed to the insulative housing, a metal piece or metallic shielding plate 6' affixed to the insulative piece, a shielding shell 9' enclosing the insulative housing for forming a receiving room 10', and a mounting clip 101' covering the shielding shell 9' and shown as a concave shape.

Figure 21:
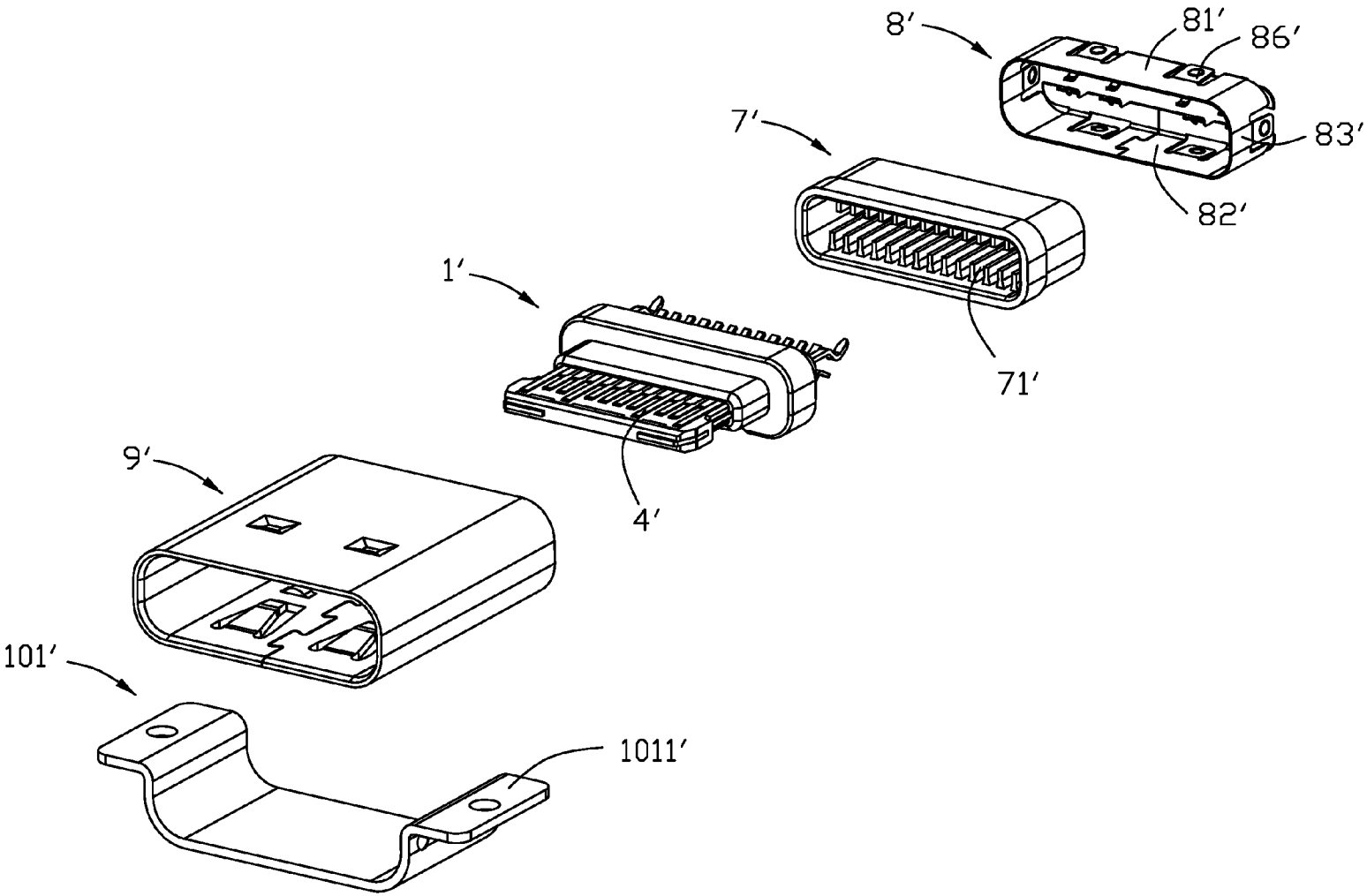
FIG. 21 is an exploded view of the electrical connector in the second embodiment.
Figure 22:
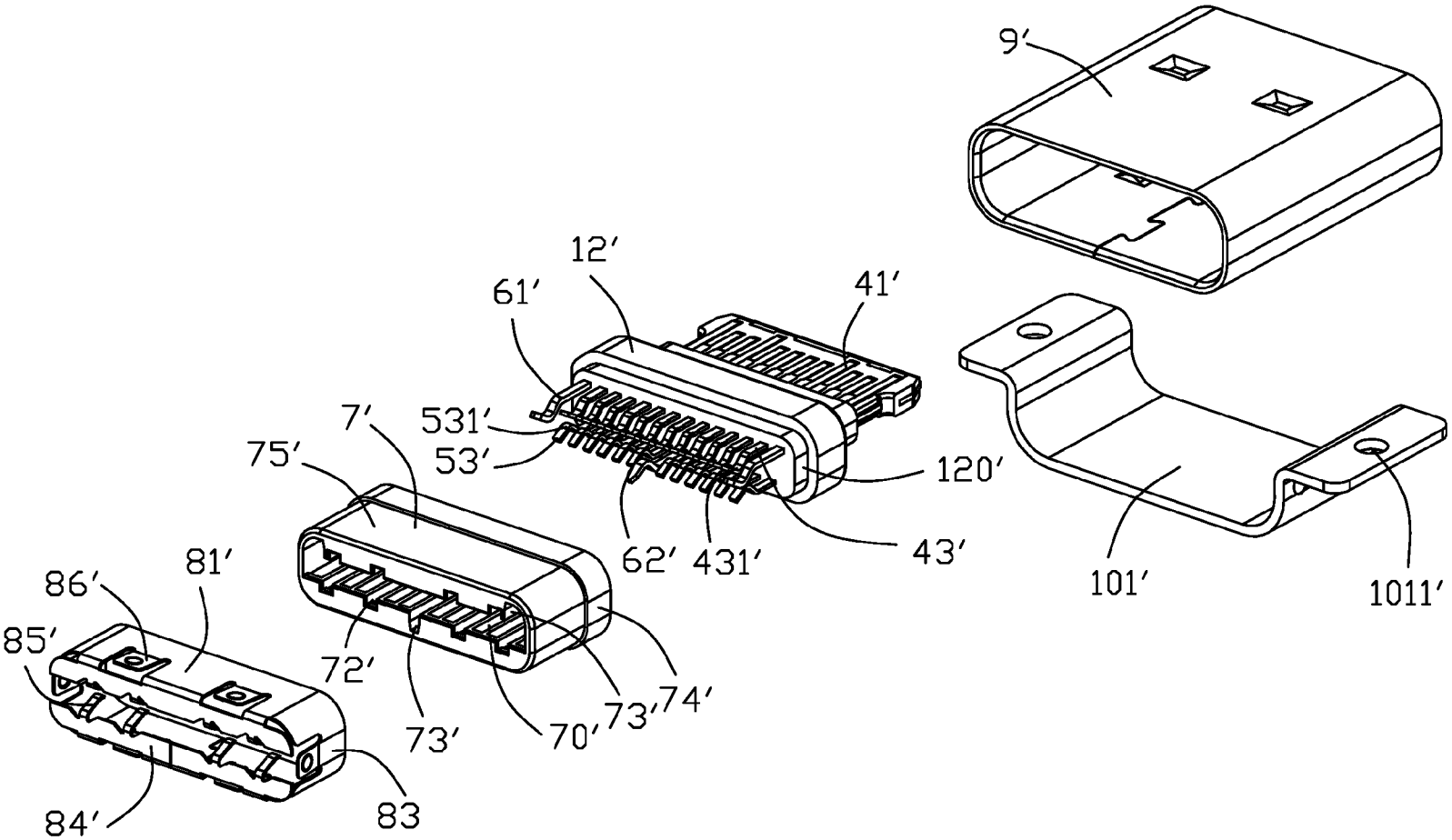
FIG. 22 is another exploded view taken from FIG. 21.
Figure 23:
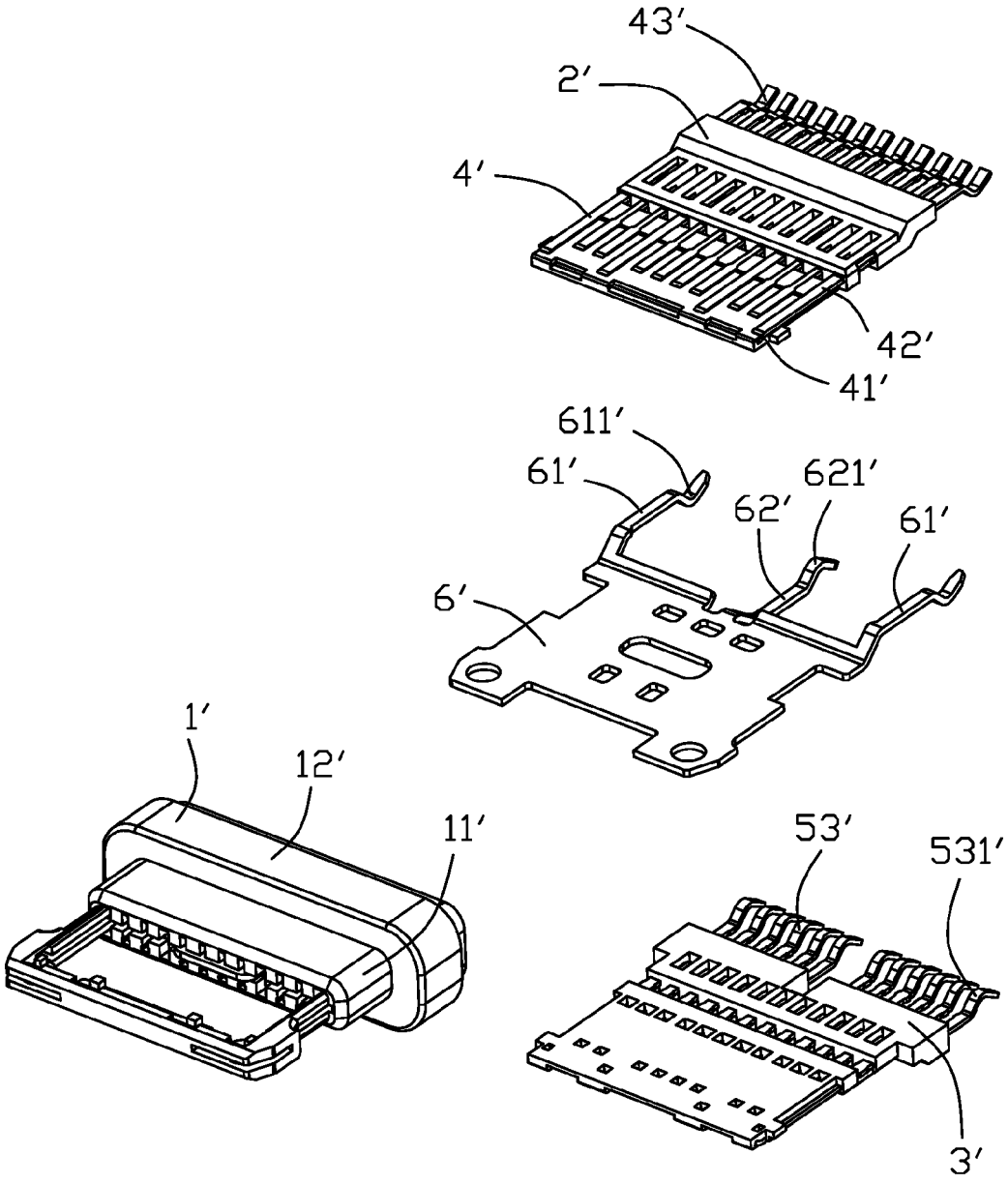
FIG. 23 is an exploded view of the insulative housing, the contacts and the shielding plate of the electrical connector.
Figure 24:
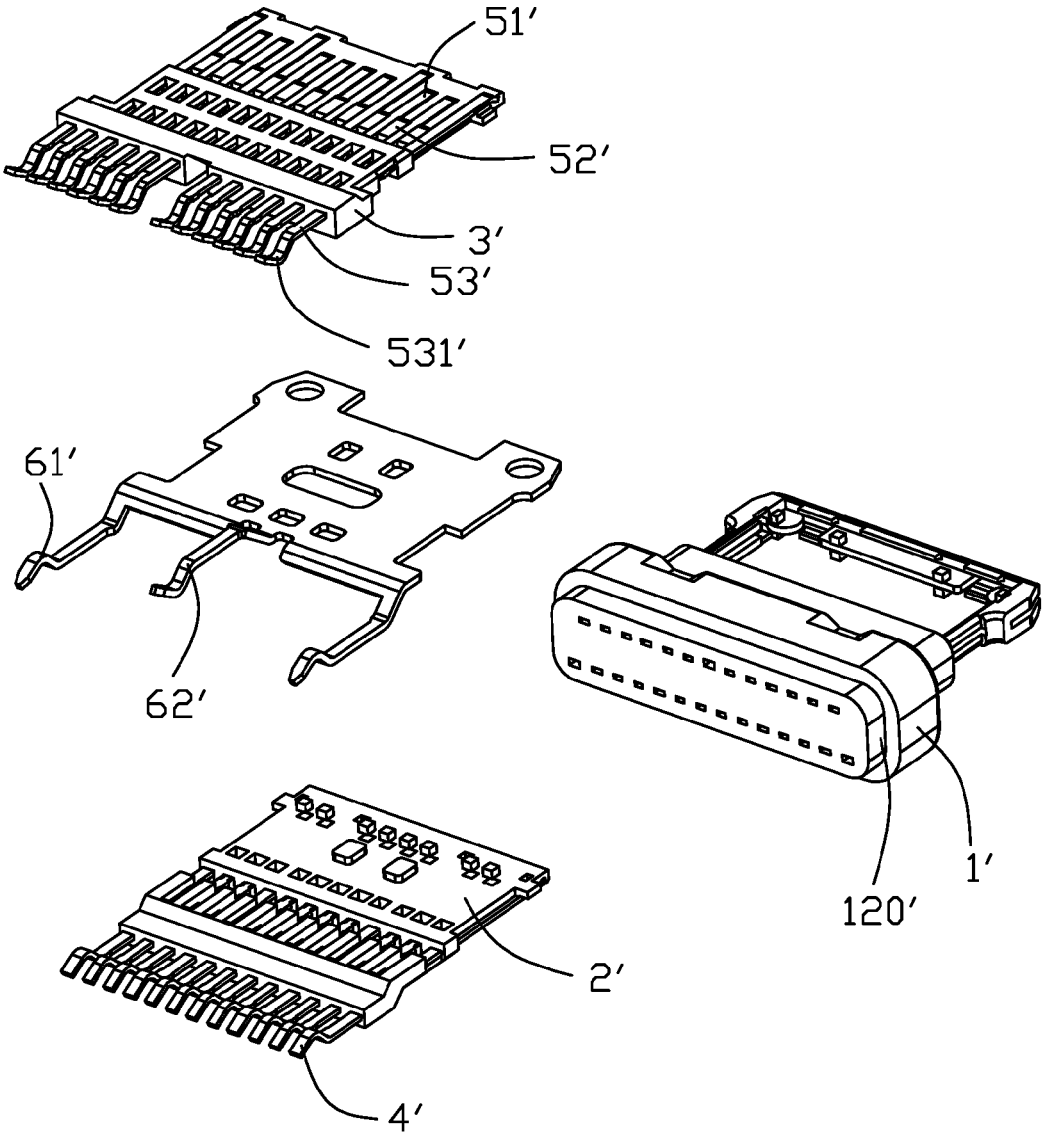
FIG. 24 is another exploded view taken from FIG. 23.
Figure 25:
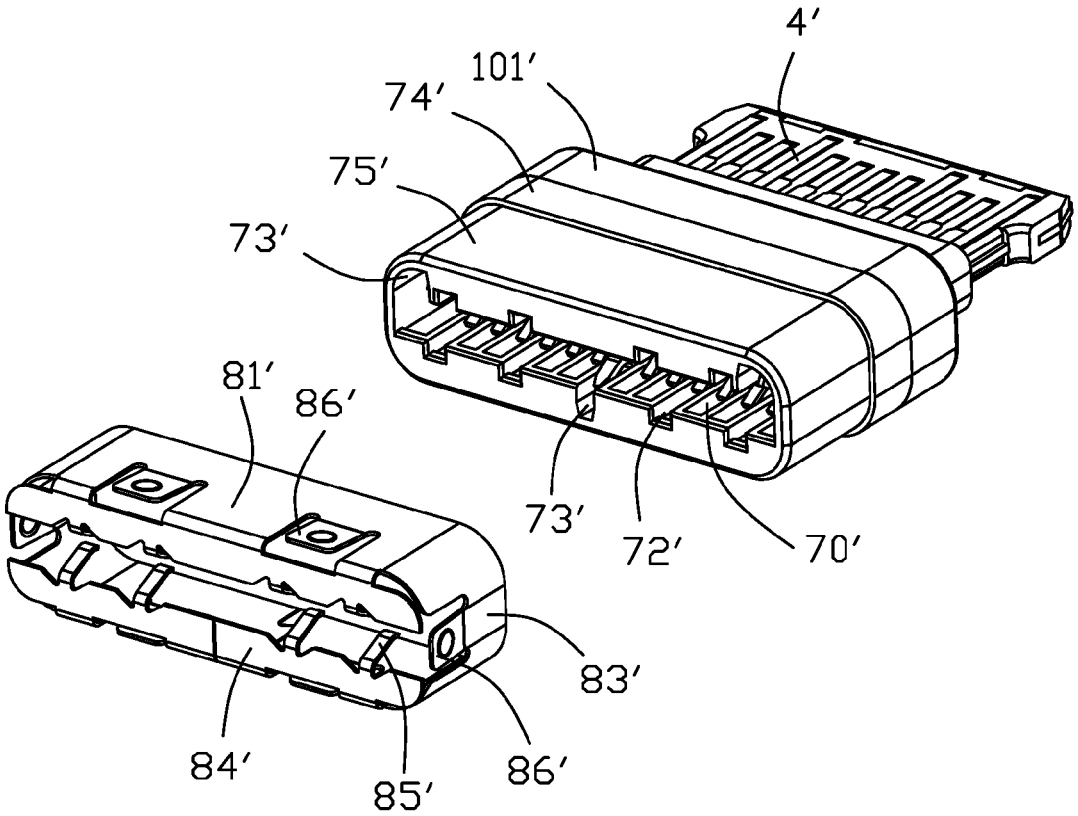
FIG. 25 is a perspective, assembled view of the insulative shell assembling to the insulative housing and the metal shell of the electrical connector in the second embodiment.
Figure 26:
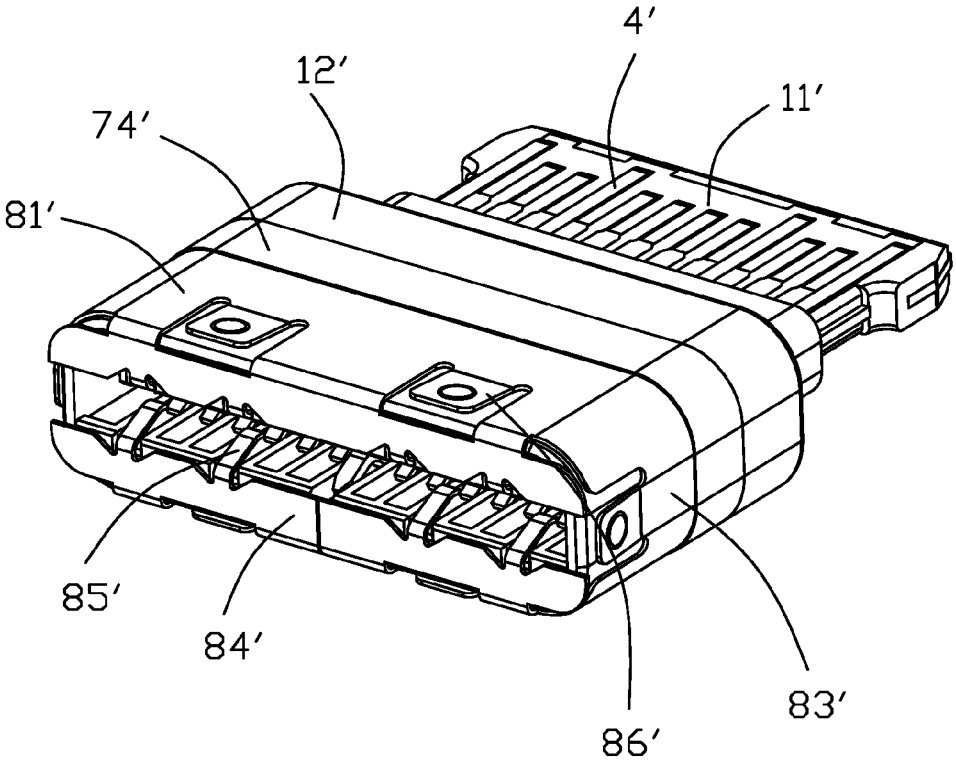
FIG. 26 is a perspective, assembled view of the metal shell assembling to the insulative shell taken from FIG. 25.
Figure 27:
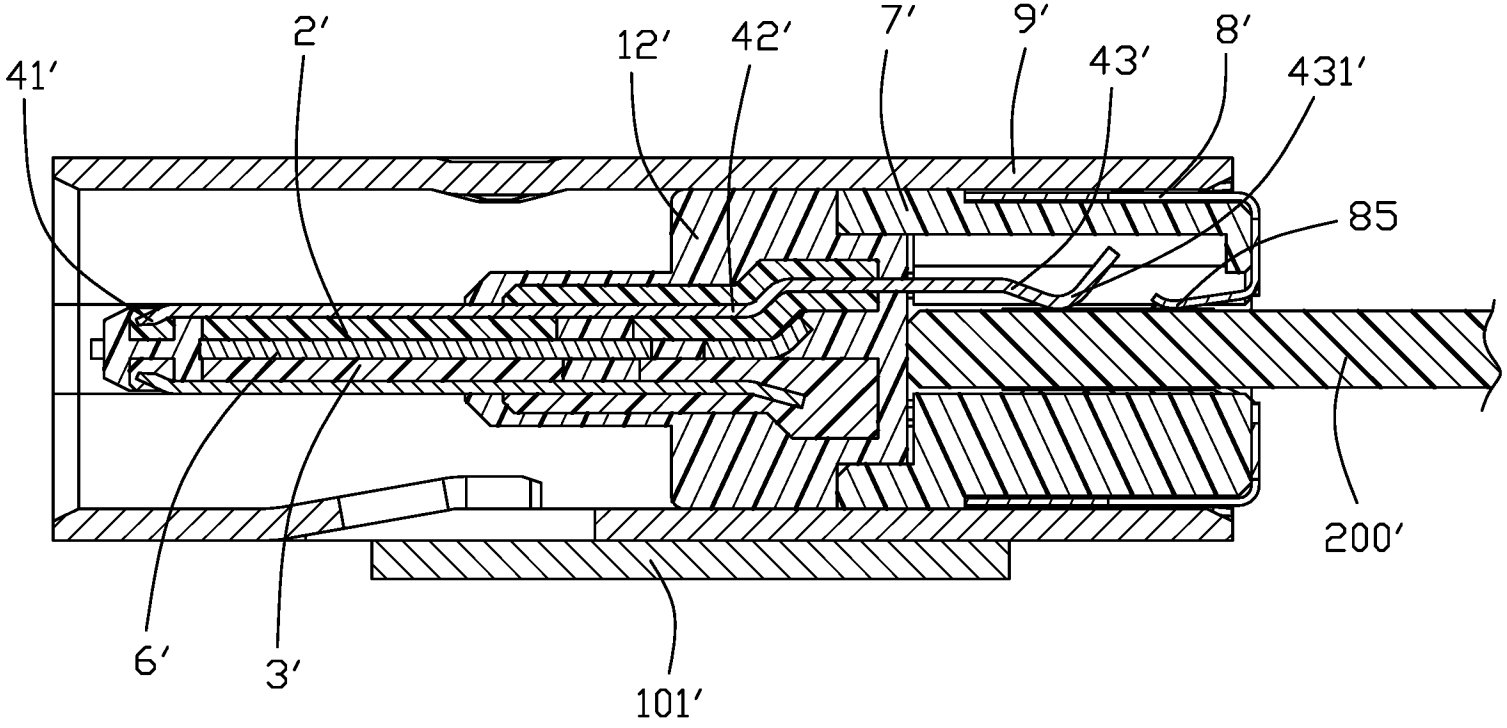
FIG. 27 is a cross-sectional view of the electrical connector assembly taken along line 27-27 in FIG. 15.
Figure 28:
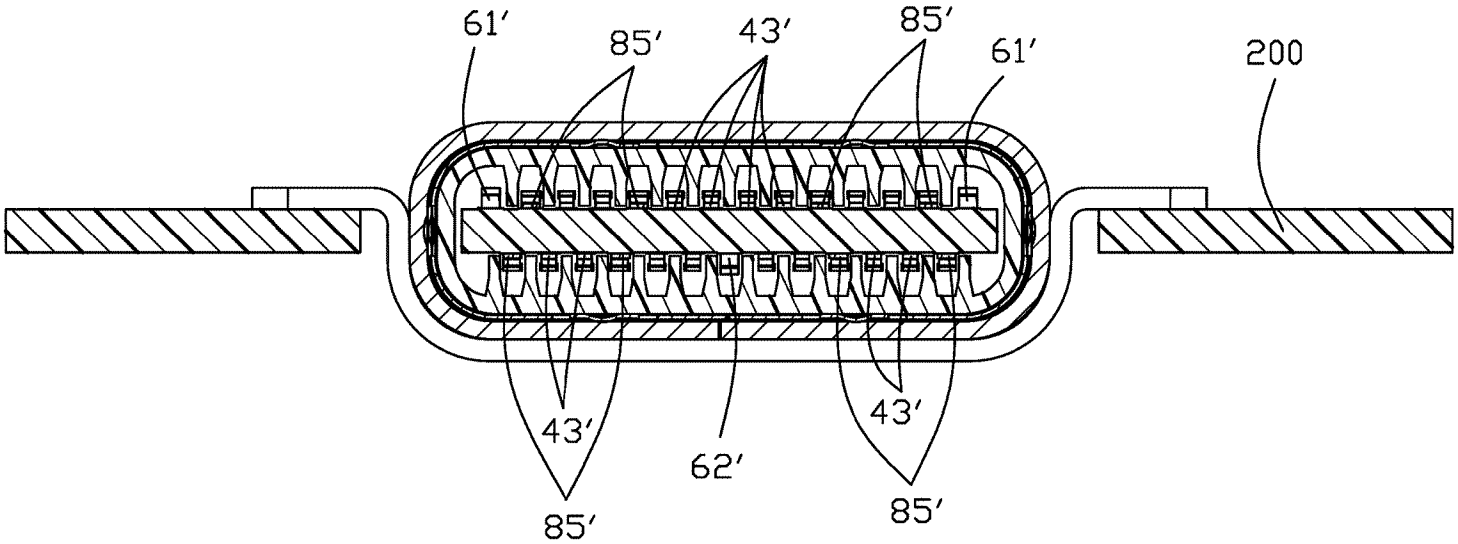
FIG. 28 is a cross-sectional view of the electrical connector assembly taken along line 28-28 in FIG. 15.

Referring to FIGS. 17 to 26, the insulative piece includes the insulative housing and an insulative shell 7' affixed to the backend of the insulative housing and having a receiving groove 70'. The insulative housing includes a second insulator 2', a third insulator 3' assembled under the second insulator 2' and a first insulator 1' partially covering the second insulator 2' and the third insulator 3'. The first insulator 1' includes a base portion 12', a tongue portion 11' extending forwardly from the base portion 12' and an annular collar 120' concaved on the backend of the base portion 12'. Referring to FIGS. 21 to 22, the insulative shell 7' covers the annular collar 120' and includes separated ribs 71' to form corresponding passageways (not labeled) for receiving the elastic portions 43'/53' of the terminals 4'/5' (illustrated later), eight opening slots 72' all affixed to the backend and three recesses 73'. The insulative shell 7' includes a first annular portion 74' attached to the annular collar 120' and a second annular portion 75' located at the rear end of the first annular portion 74'. The size of the second annular portion 75' in a transverse direction and a vertical direction perpendicular to the transverse direction is smaller than the first annular portion 74'. The outer edge of the first annular portion 74' slides smoothly to the outer edge of the base portion 12'.

Referring to FIGS. 17 to 24, the terminals include first terminals 4' and second terminals 5' on the opposite surface to the first terminals 4'. The first terminals 4' is insert molding with the second insulator 2'. The second terminals 5' is insert molding with the third insulator 3'. Each first terminal 4' includes a first contacting portion 41' exposed to the tongue portion 11' and connecting with the corresponded terminal of the corresponded electrical connector, a first connecting portion 42' embedded in the base portion 12' and connecting with the first contacting portion 41' and a first elastic portion 43' connecting with the first connecting portion 42' and penetrating the backend of the first insulator 1'. The first elastic portion 43' includes a first clipping portion 431' shown bending. The second terminals 5' are exposed to the bottom surface of the first insulator 1'. Each second terminal 5' comprises a second contacting portion 51' exposed to the bottom surface, a second connecting portion 52' embedded in the base portion 12' and connecting with the second contacting portion 51' and a second elastic portion 53' connecting with the second connecting portion 52' and penetrating the backend of the first insulator 1'. The second elastic portion 53' includes a second clipping portion 531' shown bending.

Referring to FIGS. 21 to 24, the metal piece 6' is sandwiched between the second insulator 2' and the third insulator 3'. The metal piece 6' includes a pair of edge ground terminals 61' located at two sides of the backend of the metal piece 6' and a middle ground terminal 62' between the pair of edge ground terminals 61'. The edge ground terminals 61' extend out of the backend of the first insulator and are located in the same plane with the first elastic portion 43'. The edge ground terminals 61' are located at two sides of the first elastic portion 43' and respectively includes a third clipping portion 611' shown bending. The middle ground terminal 62' extends out of the backend of the first insulator 1' and locates in the same plane with the second elastic portion 53'. The middle ground terminal 62' includes a forth clipping portion 621' shown bending.

Referring to FIGS. 15 to 22, the electrical connector includes a metal shell 8' attached to second annular portion 75'. The outer circumference of the metal shell 8' is flush with the periphery of the first annular portion 74'. The metal shell 8' includes a top wall 81' attached to the second annular portion 75', a bottom wall 82' opposite to the top wall 81', a pair of lateral walls 83' connecting the top wall 81' and the bottom wall 82', a pair of back walls 84' bending downwardly from the backend of the top wall 81' and bending upwardly from the backend of the bottom wall 82' and each back wall 84' is away from each other, eight elastic terminals/tangs 85' set in the back wall 84' in two rows along the vertical direction, and six resisting springs 86' respectively located at the top wall 81', the bottom wall 82' and the lateral walls 83'. The metal shell 8' resists the PCB 200' by the elastic terminals 85'.

The metal piece includes the shielding shell 9' and the metal shell 8'. The edge ground terminals 61' and the elastic terminals 85' extending downwardly from the top wall 81' are called the first elastic arm. The middle ground terminal 62' and the elastic terminals 85' extending upwardly from the bottom wall 82' are called the second elastic arm.

Figure 15:
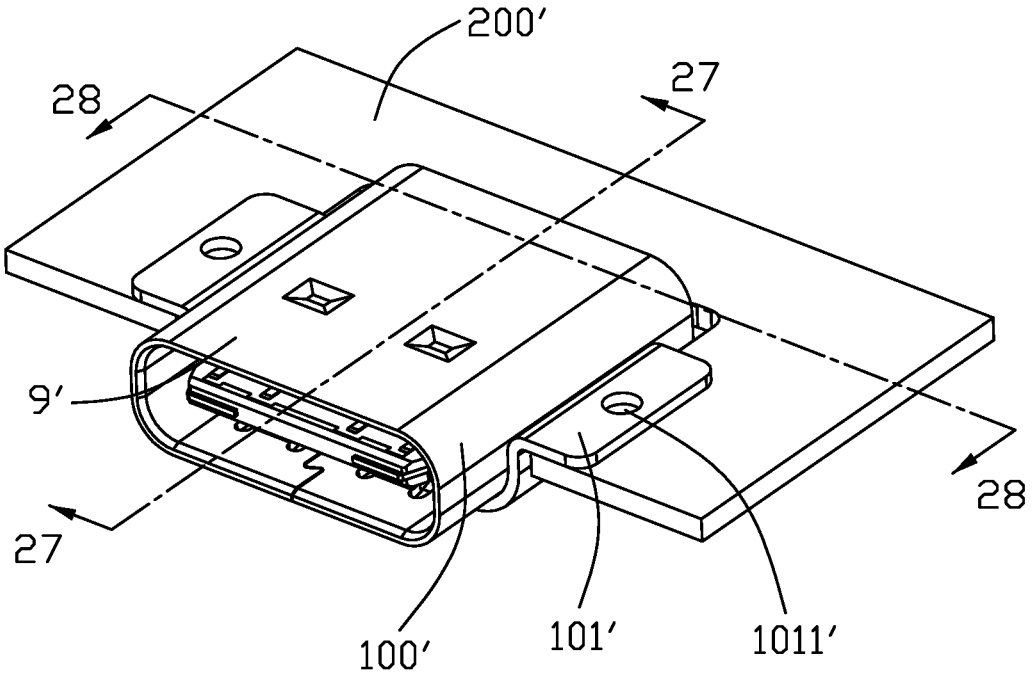
FIG. 15 is a perspective, assembled view of the electrical connector assembly in the second embodiment.
Figure 16:
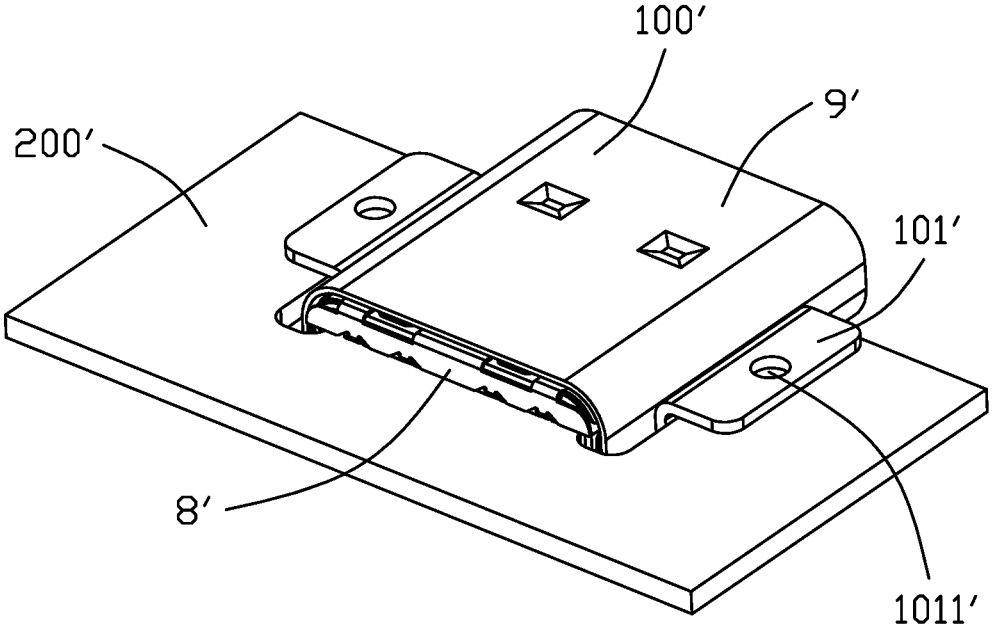
FIG. 16 is another assembled view of the electrical connector assembly taken from FIG. 15.
Figure 17:
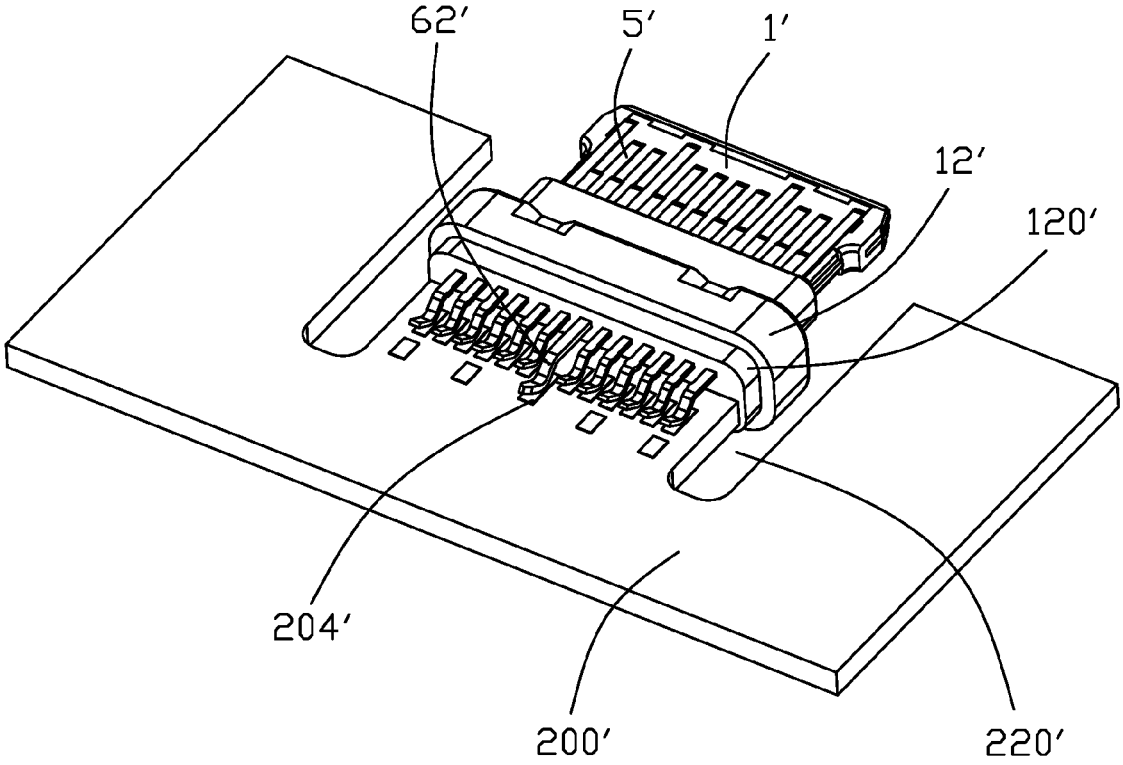
FIG. 17 is an exploded view of the electrical connector assembly removing the metal shell, the insulative shell and the shielding shell.
Figure 18:
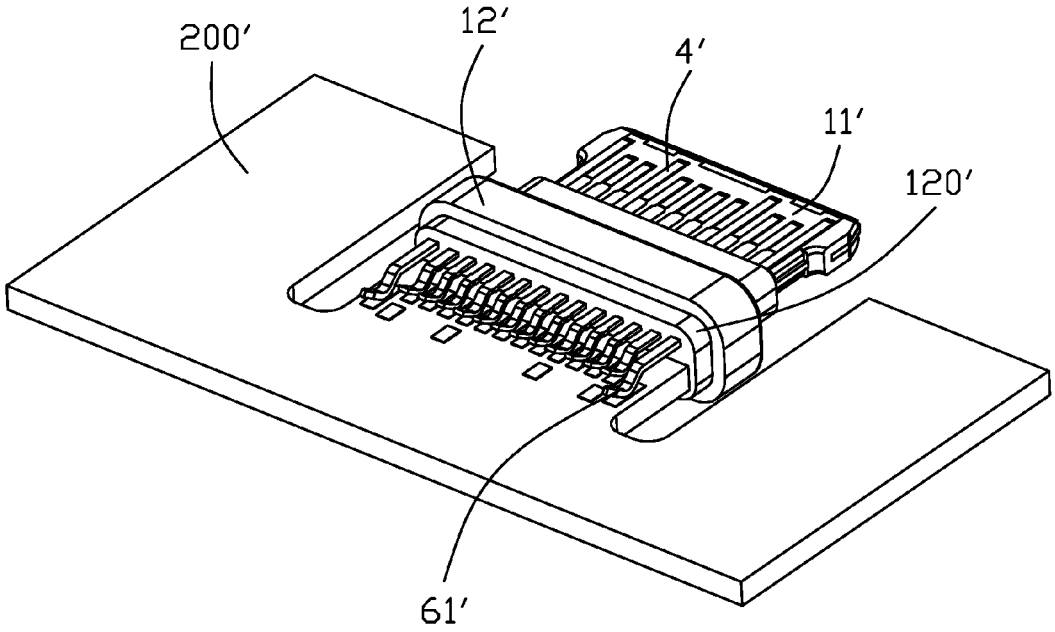
FIG. 18 is another view of the electrical connector assembly taken from FIG. 17.
Figure 19:
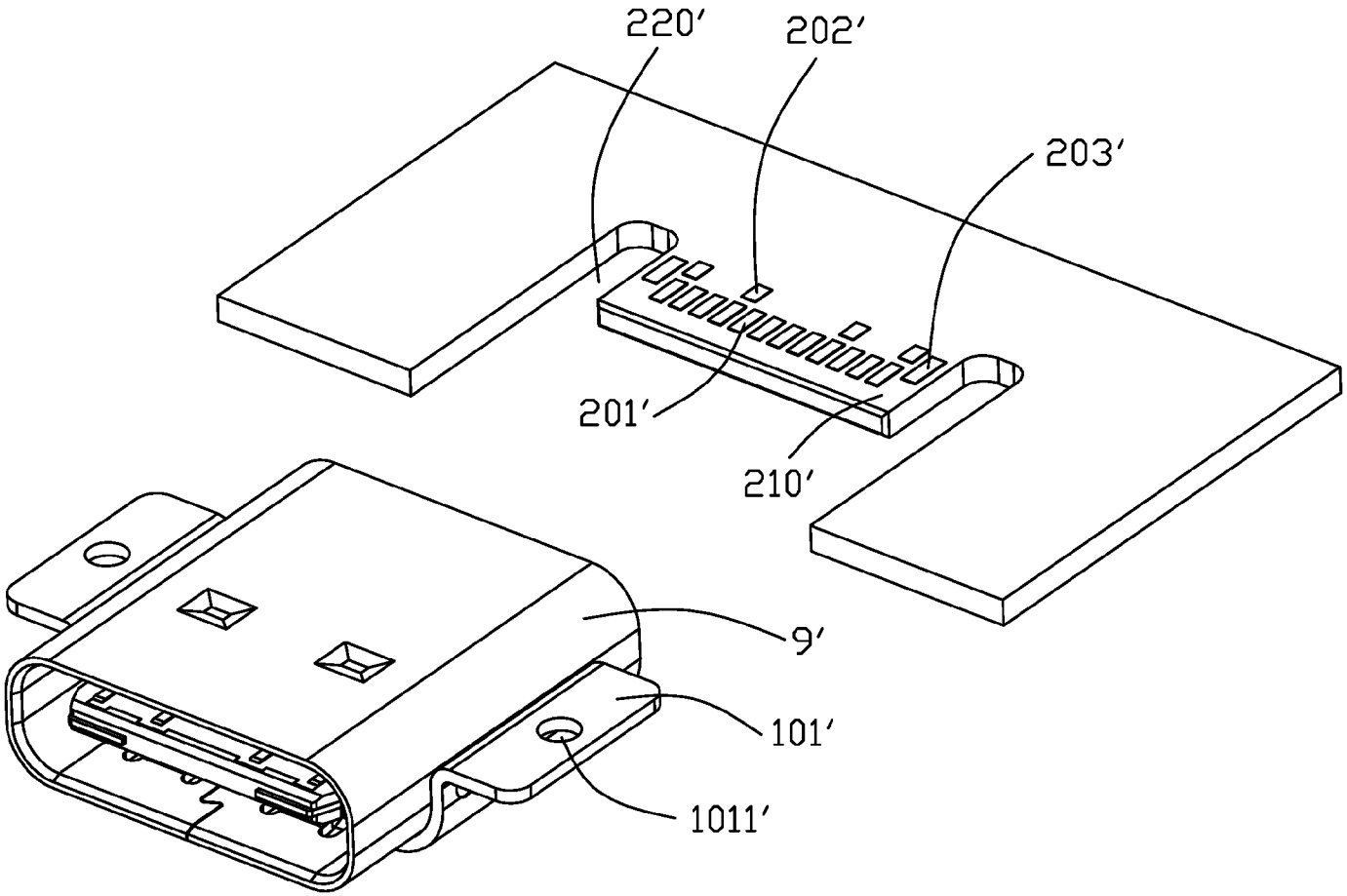
FIG. 19 is a perspective, assembled view of the electrical connector not assembling to the PCB in the second embodiment.
Figure 20:
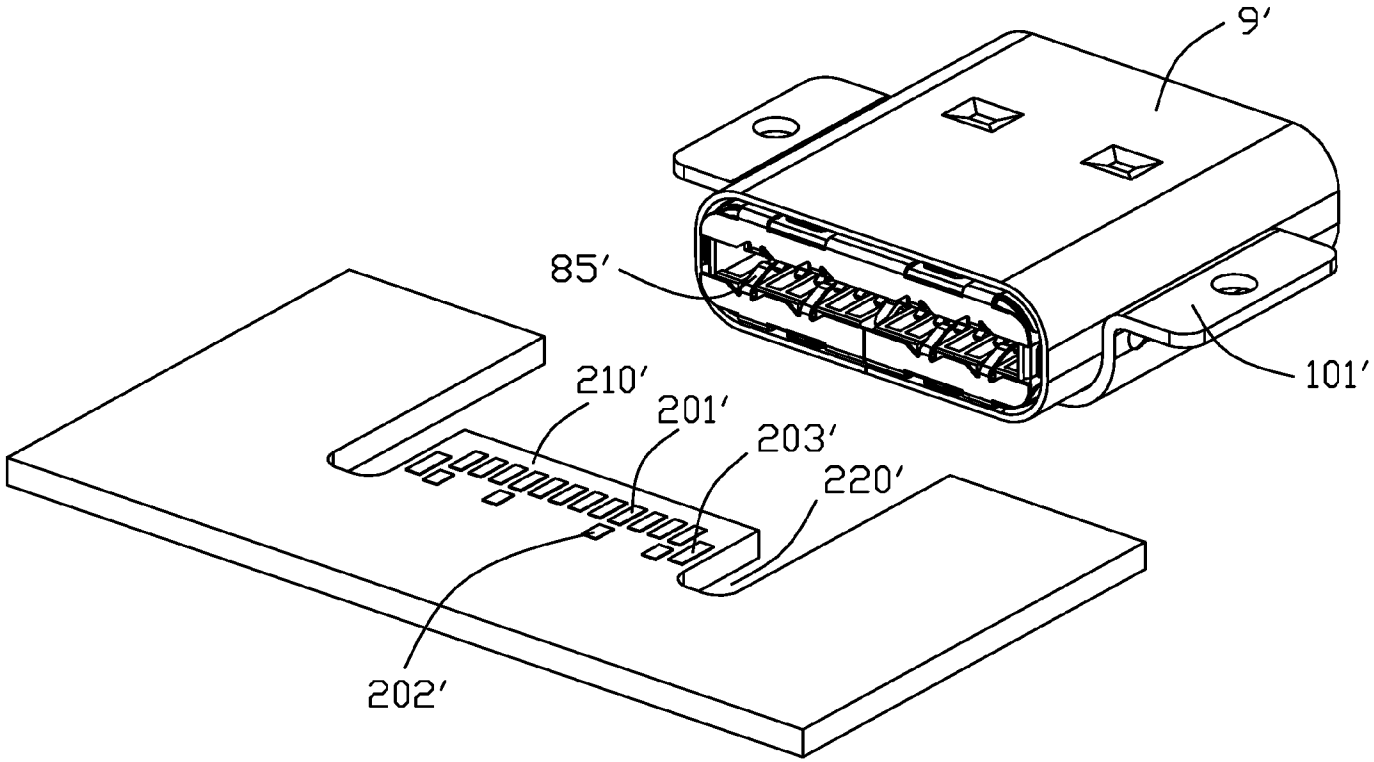
FIG. 20 is another assembled view taken from FIG. 19.

Referring to FIGS. 15 and 16, the shielding shell 9' encloses the first insulator 1' for forming a receiving room 10'. The resisting springs 86 resist the inner surface of the shielding shell 9' for fixing the metal shell 8' and the shielding shell 9'.

Referring to FIGS. 15 to 22, the mounting clip 101' is concaved-shape and used for connecting the electrical connector 100' and the PCB 200'. The mounting clip 101' includes a pair of positioning holes 1011' for fixing the electrical connector 100' to the PCB 200'.

Referring to FIGS. 17 to 20, the PCB 200' includes a main portion 210' protruding outwardly from the surface and a clipping groove 220' separating the main portion 210' and the other parts of the PCB 200'. The PCB further includes a plurality of first contacting point exposed to the upper and lower surface of the PCB and contacting with the first elastic portions 43' and the second elastic portions 53' and a plurality of backend contacting points in the rear end of the main portion 210'. The backend contacting points include eight second contacting points 202' exposed to the upper and lower surface of the PCB and located in the back of the first contacting points 201', two third contacting points 203' exposed to the upper surface of the PCB 200' and contacting with the edge ground terminals 61, and a forth contacting points 204' exposed to the lower surface of the PCB and connecting with the middle ground terminal 62'. The second contacting points 202' connect with the elastic terminals 85'. The third contacting point 203' is on the both sides of the first contacting points 201'. The forth contacting points 204' is in the middle of the second contacting points 202'.

The electrical connector 100' is connected with the PCB 200' through the metal piece making the PCB clipped by the first elastic portions 43' and the second elastic portions 53' along the vertical direction. The metal shell 8' of the metal piece includes the elastic terminals 85' fixing the PCB 200' and the metal shell 8'. The electrical connector 100' is mounted to the PCB in a positive position making it easy to replace the electrical connector if the electrical connector is out of control.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

an insulative housing comprising a base portion defining a rearward surface and a tongue portion extending forwardly from the base portion and defining opposite top and bottom surfaces thereof;

a plurality of conductive terminals affixed to the insulative housing and each comprising a contacting portion exposed to a corresponding one of the top and bottom surfaces of the tongue portion, a fixing portion embedded in the base portion, and a soldering portion extending backwardly out of the base portion;

a shielding plate affixed to the insulative housing;

a shielding shell covering the insulative housing and defining a sol space into which the rearward surface of the base portion is rearwardly exposed; and a waterproof sheet received in the sol space; wherein the base portion further comprises a stepped portion located in the sol space and behind the rearward surface in a front-to-back direction, the waterproof sheet is formed by solidification of liquid insulative material flowing from the stepped portion to the rearward surface, and encloses both the stepped portion and the rearward surface; and the shielding shell comprises a mating room receiving the tongue portion, the base portion comprises a rear portion extending backwardly, and the stepped portion comprises a plurality of stepped surfaces located in different planes at the back of the rearward surface.

2. The electrical connector as claimed in claim 1, wherein the base portion comprises a first inclining surface between the rear portion and the stepped surfaces, and a second inclining surface between the stepped surfaces.

3. The electrical connector as claimed in claim 1, wherein the rear portion comprises a plurality of through holes each located between two adjacent conductive terminals.

4. The electrical connector as claimed in claim 1, further comprising a channel penetrating the sol space, and wherein the waterproof sheet fills in the channel.

5. The electrical connector as claimed in claim 1, wherein the rear portion of the base portion comprises a pair of resisting grooves each having a limiting wall on an upper surface thereof, and the shielding shell comprises a pair of resisting portions received in the resisting grooves and bound by the limiting walls.

6. The electrical connector as claimed in claim 1, wherein the base portion comprises a pair of protrusions protruding backwardly and located in a rear end of the waterproof sheet, and the shielding shell comprises a pair of rear blocking portions located at the rear end of the shielding shell and resisting forwardly against the protrusions.

7. The electrical connector as claimed in claim 1, wherein said base portion includes a rear portion with therein a plurality of through holes each disposed between two adjacent conductive terminals along a transverse direction perpendicular to said front-to-back direction and communicating with the sol space.

8. The electrical connector as claimed in claim 7, wherein an inclining surface is formed in each of said through hole so as to lead the liquid insulative material from the stepped portion toward the rearward surface.

9. An electrical connector comprising:

an insulative housing comprising a base portion defining a rear side surface and a tongue portion extending forwardly from the base portion in a front-to-back direction, and defining opposite top and bottom surfaces thereof in a vertical direction perpendicular to said front-to-back direction;

a plurality of conductive terminals affixed to the insulative housing, each of said conductive terminals comprising a contacting portion exposed upon a corresponding one of the top and bottom surfaces of the tongue portion in the vertical direction, a fixing portion embedded in the base portion, and a soldering portion extending backwardly out of the base portion;

a shielding shell covering the insulative housing and defining a sol space to which the rear side surface of the base portion is rearwardly exposed; and a waterproof sheet received in the sol space; wherein the rear side surface is enclosed by a solidified liquid insulative material which forms said waterproof sheet; wherein said rear side surface is not flat with at least one inclined surface for guiding flowing of said liquid insulative material.

10. The electrical connector as claimed in claim 9, wherein said base portion includes a rear portion extending rearwardly behind the waterproof sheet in the front-to-back direction.

11. The electrical connector as claimed in claim 10, further including a metal shell joined with the shielding shell and having a positioning portion forwardly abutting against the rear portion of the base portion.

12. The electrical connector as claimed in claim 11, wherein said shielding shell includes a pair of rear blocking portions forwardly confronting the waterproof sheet.

13. An electrical connector comprising:

an insulative housing comprising a base portion defining a rearward surface and a tongue portion extending forwardly from the base portion and defining opposite top and bottom surfaces thereof;

a plurality of conductive terminals affixed to the insulative housing and each comprising a contacting portion exposed to a corresponding one of the top and bottom surfaces of the tongue portion, a fixing portion embedded in the base portion, and a soldering portion extending backwardly out of the base portion;

a shielding shell covering the insulative housing and defining a sol space into which the rearward surface of the base portion is rearwardly exposed; and a waterproof sheet received in the sol space; wherein the base portion further comprises a stepped portion located in the sol space and behind the rearward surface in a front-to-back direction, the waterproof sheet is formed by solidification of liquid insulative material flowing from the stepped portion to the rearward surface, and encloses both the stepped portion and the rearward surface; and the base portion includes a rear portion having a plurality of through holes each disposed between two adjacent conductive terminals and communicating with the sol space.

14. The electrical connector as claimed in claim 13, wherein an inclining surface is formed in each of said through hole so as to lead the liquid insulative material from the stepped portion toward the rearward surface.

* * * * *